US007426796B2

(12) United States Patent
Cunningham et al.

(10) Patent No.: US 7,426,796 B2
(45) Date of Patent: Sep. 23, 2008

(54) COUPLER FOR COUPLING AN ACCESSORY TO A DIPPER ARM AND A CONTROL SYSTEM FOR SUCH A COUPLER

(75) Inventors: Bartholomew James Cunningham, Navan (IE); James David Barron, Collon (IE); Anthony McKeown, Drogheda (IE)

(73) Assignee: Geith Patents Limited, Dublin (IL)

( * ) Notice: Subject to any disclaimer, the term of this patent is extended or adjusted under 35 U.S.C. 154(b) by 319 days.

(21) Appl. No.: 11/169,814

(22) Filed: Jun. 29, 2005

(65) Prior Publication Data

US 2006/0037220 A1 Feb. 23, 2006

Related U.S. Application Data

(62) Division of application No. 10/313,576, filed on Dec. 9, 2002, now Pat. No. 6,964,122.

(51) Int. Cl.
*E02F 3/96* (2006.01)

(52) U.S. Cl. ..... 37/468; 37/234; 414/723

(58) Field of Classification Search ..... 37/468, 37/403, 234, 413; 414/723
See application file for complete search history.

(56) References Cited

U.S. PATENT DOCUMENTS

| | | | | |
|---|---|---|---|---|
| 4,059,196 | A * | 11/1977 | Uchino et al. | 414/699 |
| 4,881,867 | A | 11/1989 | Essex et al. | |
| 5,082,389 | A | 1/1992 | Balemi | |
| 5,692,325 | A | 12/1997 | Kuzutani | |
| 6,058,633 | A | 5/2000 | Barden | |
| 6,132,131 | A * | 10/2000 | Nakamura et al. | 403/322.1 |
| 6,139,212 | A | 10/2000 | Heiple | |
| 6,379,075 | B1 * | 4/2002 | Shamblin et al. | 403/322.1 |
| 6,508,616 | B2 | 1/2003 | Hung | |
| 6,539,650 | B2 * | 4/2003 | Kaczmarski et al. | 37/468 |
| 6,625,909 | B1 | 9/2003 | Miller et al. | |
| 6,644,885 | B2 * | 11/2003 | Dam-Rasmussen | 403/322.3 |
| 6,688,801 | B2 * | 2/2004 | Husson | 403/322.1 |
| 6,691,438 | B2 | 2/2004 | Fatemi | |
| 6,718,663 | B1 | 4/2004 | Geraghty | |
| 6,778,097 | B1 * | 8/2004 | Kajita et al. | 340/825.69 |
| 7,032,335 | B2 * | 4/2006 | Short | 37/468 |
| 2003/0233773 | A1 * | 12/2003 | Mieger et al. | 37/468 |

FOREIGN PATENT DOCUMENTS

| | | | |
|---|---|---|---|
| DE | 20119092 | U | 1/2002 |
| GB | 2332417 | A | 6/1999 |
| JP | 06264466 | A | 9/1994 |
| WO | WO 9942670 | A | 8/1999 |

* cited by examiner

*Primary Examiner*—Thomas A Beach
(74) *Attorney, Agent, or Firm*—Dykema Gossett PLLC; Gregory M. Zinkl

(57) ABSTRACT

A control system for controlling the release of an accessory from any quick hitch coupler coupling the accessory to a hydraulically operable arm of a machine, operated by a pressurized hydraulic system. The control system can be used with a coupler for coupling an accessory to a dipper arm and a control system for such a coupler, such as a quick hitch coupler for coupling an accessory to a dipper arm of a back actor such as may be used by an earth working apparatus. The quick hitch coupler comprises a body member adapted for coupling to the dipper arm, a fixed engaging means mounted on the body member for engaging a first one of a pair of coupling pins mounted on the accessory, and a moveable engaging means mounted on the body member for engaging a second one of the pair of coupling pins of the accessory.

30 Claims, 21 Drawing Sheets

72
81
72
84
92
82
99
82

72
81
93
72
82

97
94
94
95
86
91
90
85
99
84
92
89
72
72
89
82
84
92
81
99

COUPLER FOR COUPLING AN ACCESSORY TO A DIPPER ARM AND A CONTROL SYSTEM FOR SUCH A COUPLER

This application is a divisional patent application of U.S. application Ser. No. 10/313,576, filed Dec. 9, 2002 now U.S. Pat. No. 6,964,122, which claims priority to Irish Application Serial No. S2002/0341, filed May 3, 2002 and is related to Irish Application Serial No. S2001/1047, filed Dec. 6, 2001, the entire disclosures of which are incorporated herein by reference.

FIELD OF THE INVENTION

The present invention relates to a coupler for coupling an accessory to a dipper arm of a back actor of, for example, an earth working apparatus, and in particular, the invention relates to a coupler of the type generally referred to as a quick hitch coupler for coupling an accessory to such a dipper arm. The present invention also relates to a control or operating system for controlling/operating such a coupler. The term "earth working apparatus" or "excavator" as used herein with reference to the present invention includes diggers or similar earth working apparatus, and usually in the context of a self-propelled vehicle having wheels or sectional tracks ("caterpillar tracks") on which it moves.

BACKGROUND OF THE INVENTION

Coupling devices for coupling accessories to a hydraulically operated arm of excavators are well known. These devices typically are used to attach different types of attachments for example to a dipper arm of such apparatus, for example to attach different sizes of buckets or a jack hammer or other such implements to the excavator.

The coupling device (also commonly referred to as a "coupler" or "quick hitch") is usually releasably attachable to both the (dipper) arm of an excavator and the attachment. The coupler is adapted for attachment to the arm and normally would remain on the arm and be utilized to interchangeably work different attachments on the arm. Typically, they comprise a body member which is adapted for coupling to the dipper arm, and a pair of engagement members are provided for releasably engaging a pair of spaced apart coupling pins located on the accessory. One of the engagement members typically is moveable relative to the other between an engaged state with the engagement members co-operating with each other for engaging the coupling pins of the accessory for coupling the accessory to the dipper arm, and a disengaged state for disengaging the coupling pins for releasing the accessory from the dipper arm. Typically, the moveable one of the engagement members is either slideable or pivotally carried in the body member and is moveable between the engaged and disengaged states by a ram, for example, a hydraulic ram, by a screw drive or by a linkage or lever. The engagement members most usually are formed by for example a set of hooks, typically at least two hooks. Such quick hitch couplers suffer from a number of disadvantages. In particular, where the moveable one of the two engagement members is moveable by an hydraulic ram, should the hydraulic fluid supply to the hydraulic ram fail in general, the moveable one of the engagement members returns to its disengaged state thereby releasing the accessory. This can have serious consequences, which can result in fatal accidents should the hydraulic supply to the quick hitch coupler fail when the accessory is in an elevated state with a person standing beneath it, in that the accessory could fall on the person, thus leading to fatal injuries. It will be appreciated that it is difficult for an operator to determine without leaving his cab whether the attachment is safely secured to the quick hitch coupler.

There is therefore a need for a coupler, and in particular, a quick hitch coupler for coupling an accessory to a dipper arm of a back actor which overcomes this problem.

The operation of the engagement members of the coupler are typically controlled by a hydraulic (control) ram.

A hydraulic supply from the excavator to the hydraulic control ram for the coupler is controlled by the operator of the machine operating one or more controls.

To avoid the inadvertent or accidental release of the attachment by releasing the grip of the coupler on the attachment, manually mechanical and electrically operated locking systems have been incorporated into the coupling system to ensure the attachment is only released when it is desired to do so. It is a danger that the control ram for the attachment could inadvertently be activated to release the attachment.

Mechanical locks have been provided on the coupler which require that the operator of the machine (or another person) has to manually release the mechanical lock. On the other hand in order to be effective the operator must first engage the mechanical lock—something that is not always done. Alternatively a hydraulically operated lock is provided. This lock must also be engaged by the operator.

Known electrical control systems for the release of the coupler can be operated remotely from the cab of the excavator by its operator. However there is a danger with such systems that they are accidentally operated (e.g. by accidentally hitting the remote release control) and thus release the attachment from the excavator. It will be appreciated that the release of the attachment when it is not intended to, causes a potential hazard as the attachment may fall off the coupler of the arm. If the (dipper) arm is above ground level this could potentially cause harm. In other positions the attachment might become stuck in some earth or cause damage to the dipper arm. There is thus also a need for a control system for operation of such a coupler.

OBJECT OF THE INVENTION

The present invention is directed towards providing a quick hitch coupler and also a control system for such a coupler, both of which overcome the disadvantages of existing quick hitch couplers, in particular avoiding the coupler disengaging in potentially dangerous circumstances.

SUMMARY OF THE INVENTION

According to the invention there is provided a quick hitch coupler for coupling an accessory to a dipper arm of a back actor, the quick hitch coupler comprising a body member adapted for coupling to the dipper arm, a fixed engaging means mounted on the body member for engaging a first one of a pair of coupling pins mounted on is the accessory, a moveable engaging means mounted on the body member for engaging a second one of the pair of coupling pins of the accessory, the moveable engaging means being moveable between an engaged state with the moveable engaging means engaging the second coupling pin while the fixed engaging means engages the first coupling pin for coupling the accessory to the coupler, and a disengaged state for disengaging the second coupling pin, a latch co-operable with the fixed engaging means for retaining the first coupling pin of the accessory engaged in the fixed engaging means the latch being alternately operable in a latched state co-operating with the fixed engaging means for retaining the first coupling pin in the fixed engaging means, and an unlatched state for releasing the first coupling pin from the fixed engaging means, an urging means for urging the latch into the latched state, and a drive means acting between the moveable engaging means and the latch for urging the moveable engaging means between the engaged state and the disengaged state, and for urging the latch from the latched state to the unlatched state against the urging action of the urging means when the moveable engaging means is in the disengaged state.

Ideally, the drive means and the urging means co-operate with each other so that the drive means only operates the latch between the latched and the unlatched state when the moveable engaging means has been moved from the engaged to the disengaged state.

In one embodiment of the invention a limit means is provided on the body member for co-operating with the moveable engaging means for defining a disengaged position of the moveable engaging means when the moveable engaging means is in the disengaged state.

Preferably the latch is pivotally mounted (for ease of manufacture) on the body member, and is pivotal between the latched and the unlatched states. However in another embodiment the latch could be slidably mounted on the body member.

Preferably, the drive means is a two part drive means, the respective parts of the drive means being moveable relative to each other for driving the moveable engaging means and the latch, one of the moveable parts of the drive means being connected to the latch, and the other of the moveable parts of the drive means being connected to the moveable engaging means so that on movement of the respective parts relative to each other the moveable engaging means is operated between the engaged and the disengaged states, and the latch is operated between the latched and the unlatched state.

Advantageously, both parts of the drive means are moveable relative to the body member.

In one embodiment of the invention the drive means comprises a ram, and one of the parts is formed by a housing of the ram, while the other part is formed by a piston rod of the ram.

Preferably, the moveable engaging means is slideable between the engaged and the disengaged state, and advantageously, is slideable in the body member with rectilinear motion between the engaged and the disengaged states. While the moveable engaging means is preferably slideable for ease of manufacture, however, in other embodiments the moveable engaging means could also be rotatable or pivotable between the engaged and the disengaged state.

In one embodiment of the invention the urging means acts between the latch and the body member, and preferably, the urging means is provided by a spring.

In one embodiment of the invention the urging means comprises a tension spring, and in alternative embodiment of the invention the urging means comprises a compression spring.

In one embodiment of the invention the fixed engaging means comprises a pair of fixed jaws formed by the body member and defining an open mouth for receiving the first coupling pin between the fixed jaws.

In another embodiment of the invention the latch co-operates with the fixed jaws for retaining the first coupling pin within the open mouth and between the fixed jaws.

Ideally, a pair of latches are provided at respective opposite sides of the fixed jaws.

In another embodiment of the invention the moveable engaging means defines an open mouth for receiving the second coupling pin therein, and ideally, defines the open mouth with the body member. Ideally, the open mouths defined by the respective moveable and fixed engaging means face in respective opposite directions outwardly away from each other.

Additionally, the invention provides a dipper arm having the quick hitch coupler mounted thereon.

Further the invention provides an accessory mounted to a dipper arm by the quick hitch coupler according to the invention.

Further the invention provides earth working apparatus comprising a dipper arm having the quick hitch coupler according to the invention mounted thereon.

The present invention further provides a control system for the control of the release of an attachment or accessory which includes certain advantages. This control system of the invention can be used with a coupler of the invention or with other known couplers.

The present invention provides for a control system for the control of the release of an attachment which overcomes at least certain of the disadvantages of the present invention.

The present invention provides a control system for controlling the release of an attachment (or accessory) from a coupler coupling the attachment to a hydraulically operable arm of a machine such as an excavator, the hydraulically operable arm being operable by a pressurized hydraulic system of the machine the coupler having:

a coupler body adapted for coupling to the arm;

an engagement mechanism, arranged on the coupler body (or body member), for releasably engaging the attachment, the engagement mechanism being actuatable to move the engagement mechanism between a first attachment engaging position (or engaged state) in which the engagement mechanism engages the attachment securely for working of the attachment by the arm and a second attachment release position (or disengaged state) in which the attachment is removable from the coupler;

the control system incorporating a safety control for preventing actuation of the engagement mechanism from the attachment engaging position to the attachment release position if the hydraulic pressure in at least one selected part of the hydraulic system does not exceed a threshold value (and below which threshold value the safety control prevents actuation of the engagement mechanism to the release position). This is a simple yet effective way of ensuring that the attachment is not accidentally releasable at any time. It will be appreciated in this context that the threshold value will be relatively high, in particular it is desirable that the threshold value exceeds that normally required to operate the engagement mechanism.

Where the machine has a dipper arm and in particular a number of hydraulic cylinders controlling movement of that arm, one can choose one or more places in the hydraulic system which are suitable for selection to determine if the pressure there exceeds the threshold value. A typical threshold value would be about one third of the overall system pressure.

One particularly desirable arrangement of the machine has a hydraulic ram which moves the coupler relative to the arm (normally acts between the coupler and the arm) and desirably the threshold value is measured from a hydraulic feed to that hydraulic ram. It will be appreciated that hydraulic rams may have two feeds one to outstroke (extend) the ram, the other to instroke (retract) the arm.

In one embodiment of the present invention the hydraulic system has a hydraulic line connected between a control valve and the hydraulic ram and the threshold value is measured at the hydraulic line.

In another embodiment of the present invention the hydraulic system has a valve controlling the hydraulic fluid flow to the ram and the threshold value is measured at the valve.

In the present invention it is desirable that it is the pressure in the outstroke feed for the hydraulic ram that moves the coupler relative to the arm (the "crowd" ram) that is used by the control system. The pressure threshold could be exceeded even if the crowd ram were not at maximum outstroke for example if an attachment (on the coupler) were stuck into the ground etc. However this would involve a very conscious effort on the part of the operator of the machine and in any case the attachment is in a safe position even if it were to be fully released from the coupler.

It will be appreciated that taking the pressure measurement from the crowd ram can be used to ensure the coupler, and thus the attachment, is in a desired relative position to the arm.

In one embodiment the valve is a servo valve which controls hydraulic fluid from a servo pump and the pressure at the servo valve is used by the control system to determine if the threshold value has been exceeded.

Accordingly the present invention also provides a control system for controlling the release of an attachment from a coupler coupling the attachment to a hydraulically operable arm of a machine (for example an excavator), the coupler having:

a coupler body adapted for coupling to the arm;

an engagement mechanism, arranged on the coupler body, for releasably engaging the attachment, the engagement mechanism being actuatable to move the engagement mechanism between a first attachment engaging position in which the engagement mechanism engages the attachment securely for working of the attachment by the arm and a second attachment release position in which the attachment is removable from the coupler;

the control system incorporating a safety control for preventing actuation of the engagement mechanism from the attachment engaging position to the attachment release position if the coupler is not in one or more predetermined positions relative to the arm. If an attachment is engaged on the coupler (so as to be workable by the arm) then the control system ensures that the release position is not selectable if the attachment is not in one or more predetermined positions relative to the arm.

The present invention thus assures that the release position of the coupler may only be selected (the attachment on the coupler may only be released) in certain positions or in a range of such positions. This means that an attachment on the coupler is much less likely to be released from the coupler during use of the attachment.

The control system will usually include at least one of hydraulic controls and electrical controls. In the preferred embodiments of the invention it includes both. The control system is suitably adapted for (retro-) fitting to an excavator. Alternatively it may be supplied already fitted to the machine.

The system of the present invention may be used with any type of known coupler which has the engagement system described above. Desirably the coupler is of the type sold by Geith International. Such a suitable coupler is described in Irish patent application no. S2000/0909 filed on Nov. 13, 2000 and Irish Patent application no. S2001/1047 filed on Dec. 6, 2001 of Geith Patents Limited. The latch mechanisms described therein are mechanical locks for preventing the inadvertent release of an attachment for example a bucket. The system of the present invention does not require such latches to be present.

It is desirable that the control system is remotely operable i.e. as distinct from the manually operable systems, operable at a position remote from the coupler. Desirably the remote position is from the operator's operating position which will normally be within a cab of the machine.

In one preferred embodiment of the present invention, the position(s) (orientation(s)) of the coupler (and attachment) relative to the arm in which the safety control does not prevent actuation of the engagement mechanism to the release position is a position in which an attachment is removable from the coupler but in which the attachment is not (automatically) completely disengaged from the coupler. Desirably the relative position(s) of the coupler (and attachment) and the arm in which the safety control does prevent actuation of the engagement mechanism to the release position is a position in which an attachment is automatically completely disengageable from the coupler. In the latter position(s) if the arm (and thus the attachment) of the excavator were at any significant height above ground level, the attachment (and any of its load) would be completely released by the coupler and fall from the arm, potentially landing on top of people or property causing injury/damage.

In other words the relative position(s) of the arm and the coupler at which the release of the attachment is allowed by the safety control are those in which the position to which the attachment is releasable is a partially disengaged position. The attachment can then be fully removed from the coupler if desired, for example by further moving the arm and/or the crowd position of the coupler. Suitably said partially released position is one which holds an attachment from falling from the coupler under gravity.

For example in certain embodiments the coupler may be adapted to grip the attachment at two or more locations on the attachment, for example to grip two retaining pins on the attachment. In such embodiments it is desirable that the coupler grips the attachment (i.e. the coupler and the attachment remain interengaged) at least one of said positions. In other words the attachment is released from the working position and releases to a release position which allows for removal of the attachment, but the attachment is not automatically dropped by the hitch.

For example with the coupler described in Irish patent application nos. S2000/0909 and S2001/1047 above a pair of engagement members are provided on the coupler for engaging with the attachment (in particular respectively engaging each of a pair of pins provided on the attachment). The present invention when used in conjunction with said engagement members allows the release of the attachment at a position at which at least one of said engagement members still engages with the attachment. It is particularly desirable that the partial release of the attachment achieved by the present invention holds the attachment from falling under the force of gravity.

In particular it is desirable that at least one of said engagement members are hook-shaped and remain interengaged with the attachment (to hold the attachment to the coupler) even though the engagement mechanism has been moved to the release position.

Desirably the engagement mechanism comprises a hydraulic ram or other such mechanism (for example a screw-drive mechanism) which is actuatable to move the engagement mechanism between the engaging and release positions.

According to one embodiment of the invention the hydraulically driven mechanism includes a high pressure pump and a servo pump, wherein either pump may be selected to move the engagement mechanism into a first accessory engaging state.

According to another embodiment of the invention the servo pump is used to move the engagement mechanism into a first accessory engaging state and the high pressure pump is used to move the engagement mechanism into an accessory disengaging state.

Desirably the hydraulic arm opens at least one side of opposing grips which close to grip the attachment for working thereof on the arm, and which open to at least partially engage the attachment.

In one particular construction of the system of the present invention the safety control prevents the flow of hydraulic fluid to the hydraulic ram of the engagement mechanism whenever the relative positions of the arm and the attachment are at a non-desirable release position for example positions in which the movement of the engagement mechanism to the release position would automatically completely disengage the attachment from the coupler.

With certain couplers a position at which the engagement mechanism can be actuated to move to the release position yet not cause the attachment to automatically disengage from the coupler is a position in which a hydraulic ram (in particular the "crowd ram") operating the attachment (by operation of the coupler) is in certain positions, for example fully extended or substantially fully extended. For example the attachment could be a bucket attached by the coupler to the dipper arm of an excavator and a position at which the bucket could be released from the engaged (working) position but still held by the coupler is a position in which the bucket is fully inturned (curled or folded in) toward the arm. Another way of determining the position(s) at which the safety control prevents release is to consider the angular position of the coupler relative to the arm.

Previously the hydraulic arm which operates the engagement means can be activated and fed to the ram in the coupler regardless of the angular position of the coupler or quick hitch. As pointed out this operation is a safety hazard, as in the instance where there is an attachment fitted to the coupler and the coupler is orientated in a position where the open jaw of an engagement member is facing downwards. If the coupler ram is activated by pressure from the excavator to in-stroke the ram and release the attachment pins from being locked in position, then the attachment could possibly fall out of the coupler.

In one embodiment of the invention a sensor which detects the relative position of the coupler and the arm is a pressure sensor. For example the pressure in a hydraulic supply line can be sensed and employed to control the operation of the coupler, more specifically preventing actuation of the engagement mechanism from the attachment engaging position to the attachment release position if the attachment is not in one or more predetermined positions relative to the arm. In one preferred embodiment the control system incorporates a pressure sensor in (fluid) communication with a hydraulic line of a machine to which the control system is fitted; the pressure sensor controlling the actuation of the engagement mechanism from the attachment engaging position to the attachment release position if the attachment is not in one or more predetermined positions relative to the arm. More particularly the pressure sensor could be incorporated in a pressure sensitive valve in (fluid) communication with a hydraulic feed line to a hydraulic cylinder for actuating the engagement mechanism. In this latter arrangement direct control of hydraulic fluid flow to the hydraulic cylinder is achievable. This is a particularly simple yet effective arrangement.

In another embodiment of the invention the relative position of the coupler (and/or the attachment) and the arm is sensed using a positional (for example a proximity sensor). The positional information about the position is employed in a logic circuit to determine if the engagement mechanism should be actuated or not. The positional sensor will detect the relative position of the coupler to the dipper arm. This may be done directly by sensing the actual position of the coupler relative to the arm or indirectly by sensing the position of a part of the mechanism which moves when the position of the coupler (relative to the dipper arm) is moved. For example a positioning sensor may be used to determine if the coupler and/or a part of a mechanism (which moves when the coupler position is moved) are proximate to the dipper arm. For example a proximity sensor of the reed switch type could be used. One part of the sensor may be on the dipper arm and a second part of the sensor on the coupler (or part may be with the coupler). The parts may be a control switch and a magnet which activates the control switch. A logic circuit may detect from the information received from the sensor that the position of the coupler relative to the arm is not a position where the crowd ram is fully outstroked (i.e when the position of the attachment is one that could be a safety hazard should the attachment be released from the coupler), and prevents the actuation of the engagement mechanism to the attachment release position. When a suitable position is reached the circuit will fulfill at least one condition that allows release of the attachment from the coupler.

In one embodiment the pressure sensor activates when a control pressure is reached within the hydraulic line.

In another embodiment the pressure sensor activates when a control pressure is reached at the servo port of the control valve of the machine.

In yet another embodiment a proximity sensor in communication with the control system; the proximity sensor for controlling the actuation of the engagement mechanism from the accessory engaged state to the accessory disengaged state if the accessory is not in one or more predetermined positions relative to the arm. The proximity sensor provides an electrical signal to enable actuation of the engagement mechanism from the accessory engaged state to the accessory disengaged state when the accessory is in one or more predetermined positions relative to the arm.

For example the pressure sensor may be selected so that it is activated only when a certain minimum pressure in the line is reached or the ratio of the pressure in the line to the pressure elsewhere in the hydraulic system reaches a certain value. One simple construction which employs such an arrangement is where the pressure sensor senses pressure in a line to a hydraulic cylinder for moving at least part of the arm of an hydraulic arm. In one preferred arrangement (mentioned above) the control pressure is set to be the pressure reached in a line when at least one of the hydraulic cylinders supplied by the line is in a maximum extended position. As above it is preferred that the pressure sensor is in fluid communication with a hydraulic fluid supply line to the or at least one of the hydraulic cylinders which control the relative angle of the coupler to the arm (control articulation of the coupler on the arm).

The control pressure may be a set pressure above which the safety control allows operation of the engagement mechanism or may be a relative pressure ratio i.e the pressure in one part of the system relative to another.

In one embodiment the pressure control prevents hydraulic fluid from exiting a hydraulic ram for operating the engagement mechanism on instroke action of the ram until the control pressure is reached. In one particular arrangement the pressure control allows the hydraulic fluid to exit the hydraulic ram for operating the engagement mechanism on instroke action of the ram when a control pressure is reached in the line feeding the instroke action of the ram. One arrangement for achieving this functionality is to employ a check valve on the line the hydraulic fluid exits through (on instroke action of the ram)and which opens when a control pressure is reached in the feed line.

In one construction the pressure in the hydraulic line for feeding the instroke of the hydraulic ram is pressure from the line feeding the outstroke action of a hydraulic ram operating the coupler. It is desirable that at least one other control feature such as a second valve which must be activated to allow hydraulic fluid to flow to the instroke line of the hydraulic ram is in place. In one arrangement said second valve is arranged to prevent hydraulic fluid flow to the instroke line of the hydraulic cylinder. Desirably said second valve is arranged to control hydraulic fluid flow from the outstroke line for the (crowd) ram for moving the coupler, to the instroke line for the hydraulic ram of the engagement mechanism. The second valve is desirably actuatable by the operator of the machine, for example by way of a switch such as one incorporating a time delay mechanism.

In an alternative arrangement it is desirable that a system such as that described above has a pressure sensor which activates a valve on the hydraulic feed line for the instroke of the hydraulic cylinder and in which the hydraulic fluid flow for the instroke of the coupler cylinder does not necessarily come from the outstroke line of the crowd cylinder. Instead it is preferred that the hydraulic fluid in the outstroke line of the crowd cylinder is used to build up the control pressure to which the pressure sensor is subjected. The hydraulic fluid to instroking of the coupler ram comes from elsewhere in the system.

It will be appreciated that the term "instroking" used above refers to the movement of the ram to release the attachment—it will be appreciated that the coupler could be configured so that outstroking the ram causes release of the attachment also. It is desirable also that the system above is not the sole control for actuation of the engagement mechanism from the attachment engaging position to the attachment release position if the attachment is not in one or more predetermined positions relative to the arm. In particular it is desirable that one or more other controls are incorporated in the system for example, one or more other controls for actuation of the engagement mechanism. Typically such a control would include a electrical and/or hydraulic signal which typically operate a valve which must be opened or closed to actuate the engagement mechanism as desired.

In one preferred embodiment a valve may be provided in the hydraulic line to a hydraulic cylinder for actuation of the engagement mechanism which can only be actuated to move to the release position if two or more conditions are fulfilled simultaneously (and/or within a selected time interval of each other), for example the pressure in a given hydraulic line has reached a desired level and a second signal, for example an electrical signal, from an operator control, has been received. In one particular construction the second signal is an electrical signal from an operator control. The electrical signal from the operator control can also be controlled by some further safety controls for example having two or more controls which must be activated independently to send the signal. For example an arrangement whereby the operator must actuate two or more controls within a predetermined time of each other (and preferably in a set sequence) to send the electrical signal is of particular interest.

Furthermore it is desirable to provide a visual and/or audible signal to the operator that the release mechanism has been activated. This may be done simply by including a buzzer and/or flashing light or the like for the operator, for example on a control console within the operator cab of the machine.

It is desirable that the hydraulic system of the vehicle to which the control system is fitted include pressure sensitive valves which act to prevent release of hydraulic fluid from the machine should for example a leakage occur (burst hydraulic hose or pipe etc.).

The invention also relates to a hydraulically operated arm having a control system of the invention fitted thereto. The invention also relates to a machine having at least one hydraulic arm and having a control system of the invention fitted thereto.

The invention also relates to an excavator machine having a coupler and a control system. The invention also relates to a coupler being controlled by a control system. The invention also relates to a kit comprising a coupler and a control system. The invention relates to a combined control and coupler system having a coupler and a control system.

BRIEF DESCRIPTION OF THE DRAWINGS

The invention will be more clearly understood from the following description of some embodiments thereof which are given by way of example only with reference to the accompanying drawings in which.

DETAILED DESCRIPTION OF THE DRAWINGS

Figure 1:
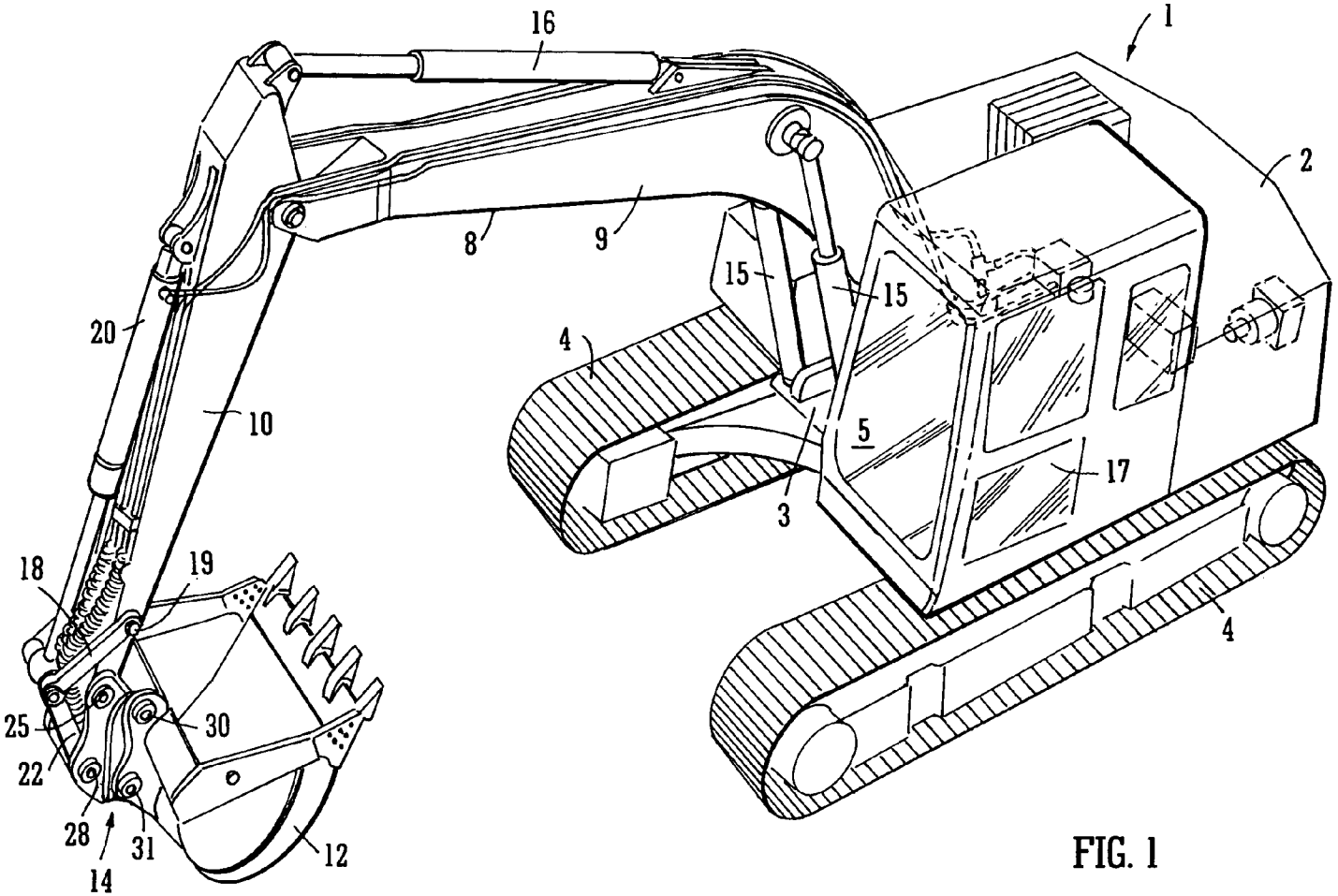
FIG. 1 is an outlined perspective view of an earth working apparatus having a back actor mounted thereto and an excavator bucket hitched to a dipper arm of the back actor by a quick hitch coupler, both of which are according to the invention.

Referring to the drawings and initially to FIG. 1 there is illustrated an earth working apparatus according to the invention indicated generally by the reference numeral 1. The apparatus 1 comprises a main housing 2 which is carried on a main chassis 3, which in turn is carried on ground engaging tracks 4. The main housing 2 is mounted on a sub-housing 5 which is rotatably carried on the main chassis 3 about a vertically extending axis, so that the sub-housing 5 and the main housing 2 are rotatable through 360° relative to the main chassis 3. This aspect of such earth working apparatus will be well known to those skilled in the art. A back actor arm 8 is mounted on the sub-chassis 5 and comprises a boom 9 which is pivotally connected to the sub-chassis 5 and extends upwardly therefrom. A dipper arm 10 is pivotally carried on the boom 9 for in turn pivotally carrying an accessory or attachment, which in this embodiment of the invention is an earth moving bucket 12. The distal (free) end of the dipper arm 10 is adapted to enable attachment of accessories. A quick hitch coupler according to the invention and indicated generally by the reference numeral 14 releasably hitches the bucket 12 to the dipper arm 10. The quick hitch coupler 14 is described in detail below. A pair of boom operating rams 15 acting between the sub-chassis 5 and the boom 9 operate the boom 9 for raising and lowering the boom 9 about its pivot connection to the sub-chassis 5. A dipper arm operating ram 16 acting between the boom 9 and the dipper arm 10 pivots the dipper arm 10 relative to the boom 9. The ram 16 controls the reach of the arm 10 by controlling the angle of the dipper arm 10 relative to the boom 9. However the operation of a boom and dipper arm of such earth working apparatus will be well known to those skilled in the art, and it is not intended to describe this aspect of the invention further. The operation of the quick hitch or coupler 14 is controlled by a hydraulic ram 70 (best seen in FIGS. 2-4) and as will be described in more detail below.

A cab 17 located in the main housing 2 accommodates an operator of the apparatus 1.

A pivotally mounted connecting linkage 18 is pivotally connected by a pair of pivot pins 19 to the dipper arm 10 towards the distal end thereof. An accessory operating (or crowd) ram 20 acting between the dipper arm 10 and the connecting linkage 18 is provided for pivoting the connecting linkage 18 for in turn pivoting the bucket 12 relative to the dipper arm 10. The angle of the coupler 14 relative to the arm 8 (and in particular relative to the dipper arm 10) is therefore controlled by the hydraulic ram 20. A pair of mounting linkages 22 extending from the connecting linkage 18 are provided for connecting the bucket 12 to the connecting linkage 18. The mounting linkages 22 terminate in bushed bores (not shown) for engaging a first connector pin 25 for connecting the quick hitch coupler 14 to the mounting linkage 22. A bushed bore (not shown) extending through the dipper arm 10 at the distal end thereof accommodates a second connector pin 28 also for pivotally connecting the quick hitch coupler 14 to the dipper arm 10.

A pair of coupling pins, namely, a first coupling pin 30 and a second coupling pin 31 are provided on the bucket 12, or indeed, on any other accessory to be connected to the dipper arm 10 for engagement with the quick hitch coupler 14 as will be described below.

Referring now in particular to FIGS. 2 to 8, the quick hitch coupler 14 according to one embodiment of the invention comprises a body member 35 formed by a pair of spaced apart side plates 36 of steel and a transversely extending connector plate 37 also of steel extending between the adjoining side plates 36. The side plates 36 each comprise a main side plate 36*a* and reinforcing side plates 36*b* and 36*c* welded together, however, for convenience the combination of the main and reinforcing side plates 36*a*, 36*b* and 36*c* are referred to as the side plates 36. A pair of connector members 38 and 39 of steel plate extend between the side plates 36 at opposite ends of the connector plate 37 for reinforcing the body member 35. The connector plate 37 and the connector members 38 and 39 are welded to the side plates 36.

A connecting means for connecting the quick hitch coupler 14 to the dipper arm 10 and the mounting linkages 22 comprises a pair of bushed bores 40 and 41 which extend through the respective side plates 36. The bushed bores 40 in the side plates 36 are aligned with each other for in turn aligning with the bushed bores in the mounting linkages 22 for engagement with the first connector pin 25. The bushed bores 41 in the respective side plates 36 are aligned with each other for in turn alignment with the bushed bore through the dipper arm 10 for engagement with the second connector pin 28. In this way the quick hitch coupler 14 is connected to the dipper arm 10 and the mounting linkages 22, and is thus pivotal about the second connector pin 28 by the mounting linkages 22 under the action of the accessory operating ram 20 for in turn pivoting the bucket 12.

The side plates 36 define corresponding pairs of fixed jaws 45 and 46 for forming a fixed engaging means for engaging the first coupling pin 30 of the bucket 12. The jaws 45 and 46 define an open mouth 47 which faces outwardly of the quick hitch coupler 14 for receiving the first coupling pin 30.

A pair of latches 50 are pivotally mounted one on each side plate 36 and then joined to operate as one single latch. The latches 50 are pivotal between a latched state illustrated in FIG. 3 co-operating with the fixed jaws 45 and 46 for extending across the open mouth 47 defined by the jaws 45 and 46 for retaining the first coupling pin 30 within the jaws 45 and 46, and an unlatched state illustrated in FIG. 2 for releasing the first coupling pin 30 from the fixed jaws 45 and 46 through the open mouth 47. The latches 50 are pivotally carried on pivot pins 52 which extend from the corresponding side plates 36 and are urged into the latched state by a pair of tension springs 53 acting between the respective latches 50 and the connector member 38. The operation of the latches 50 is described in detail below.

Figure 2:
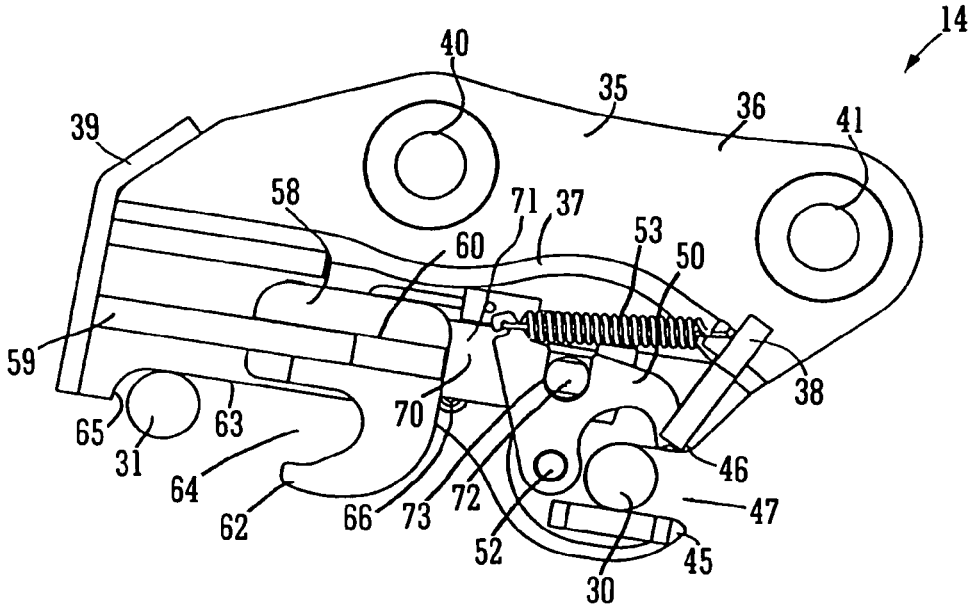
FIG. 2 is a cut-away side elevational view of the quick hitch coupler of FIG. 1.
Figure 3:
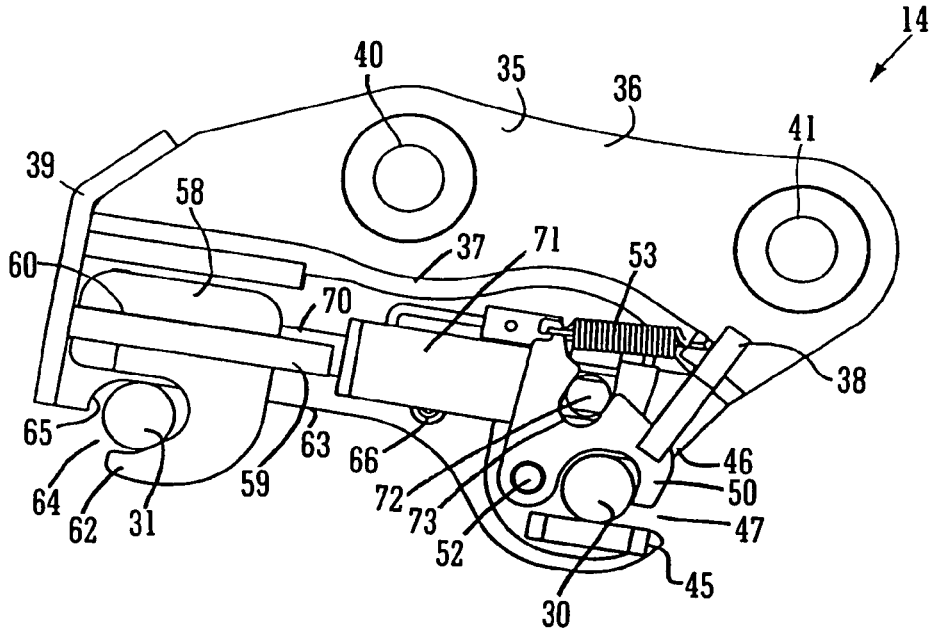
FIG. 3 is a view similar to FIG. 2 of the quick hitch coupler of FIG. 1 illustrating parts of the quick hitch coupler in a different position to that of FIG. 2.
Figure 4:
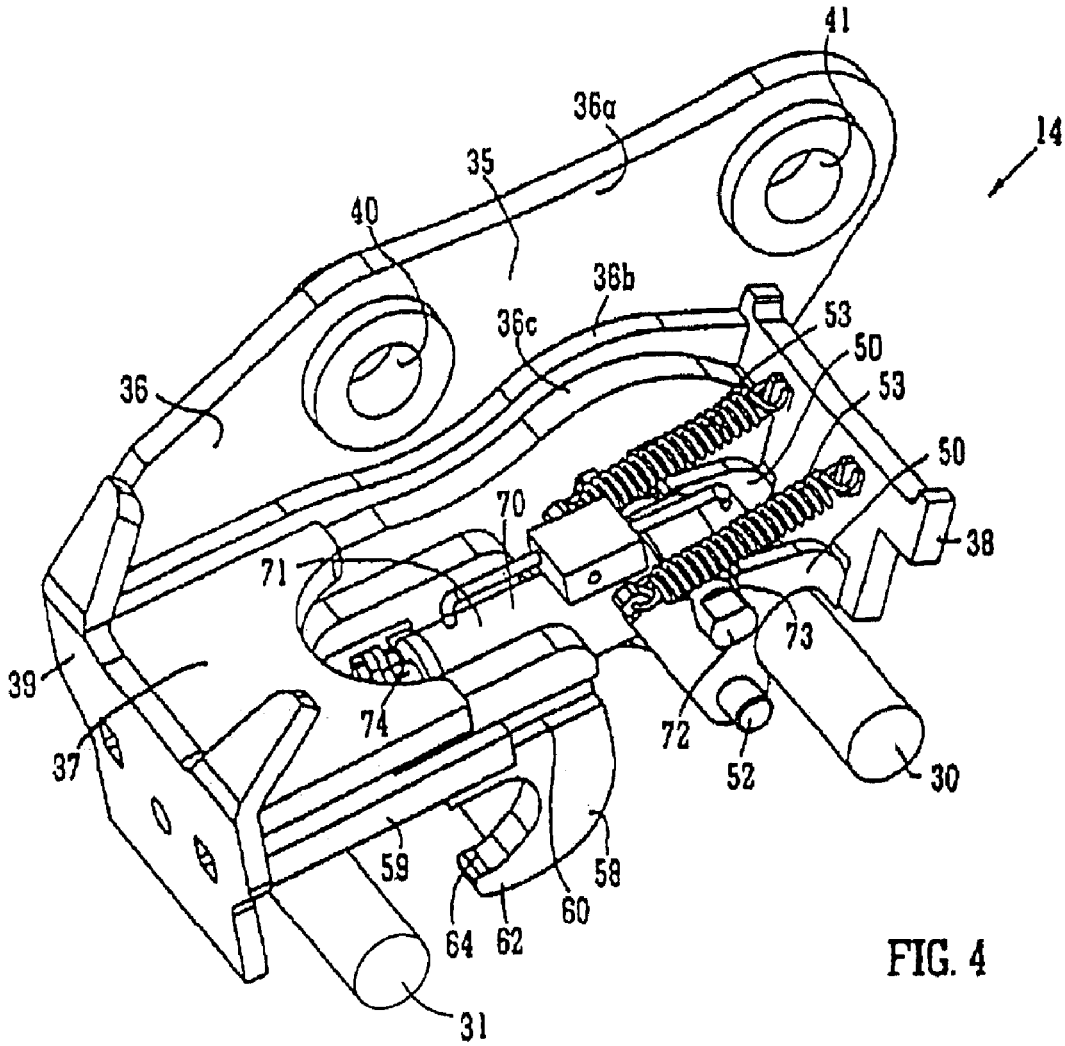
FIG. 4 is a cut-away perspective view of the quick hitch coupler of FIG. 1.
Figure 5:
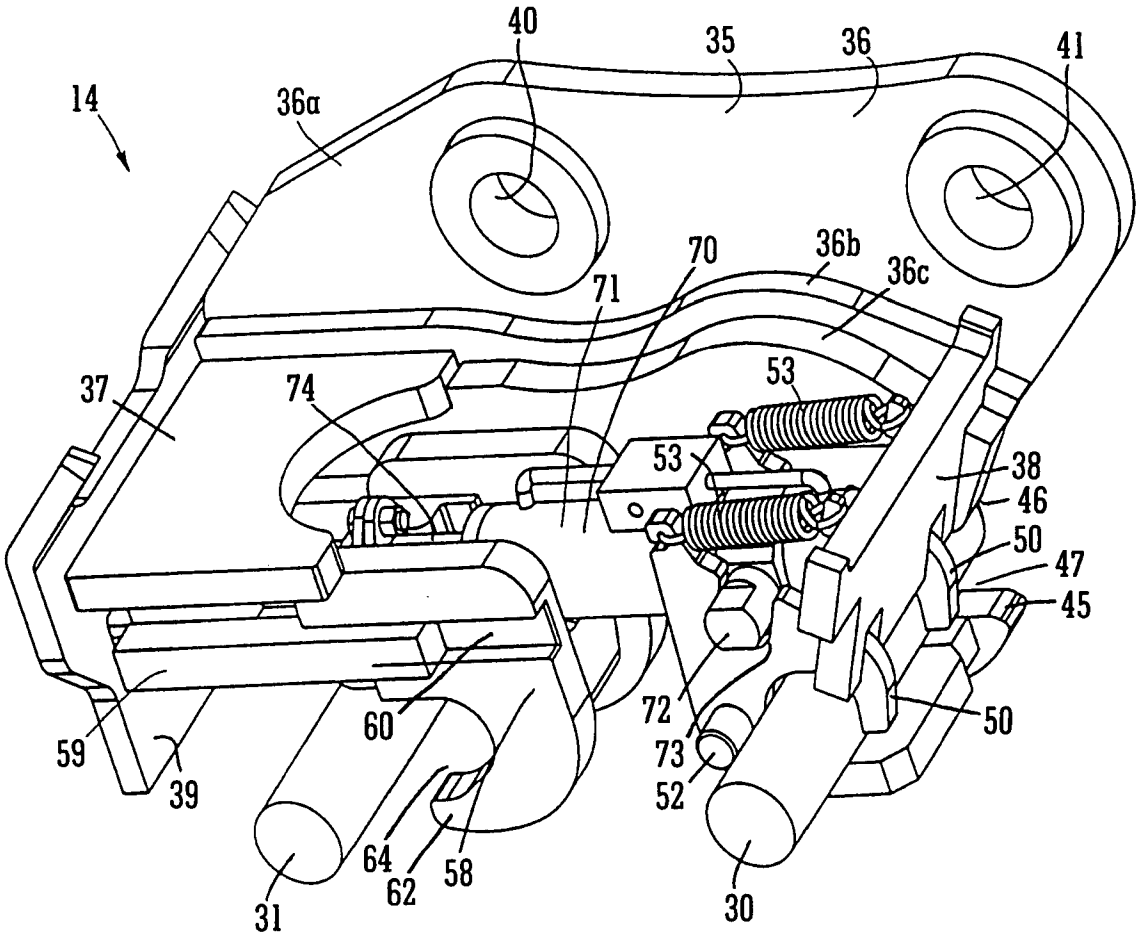
FIG. 5 is another cut-away perspective of the quick hitch coupler of FIG. 1.
Figure 6:
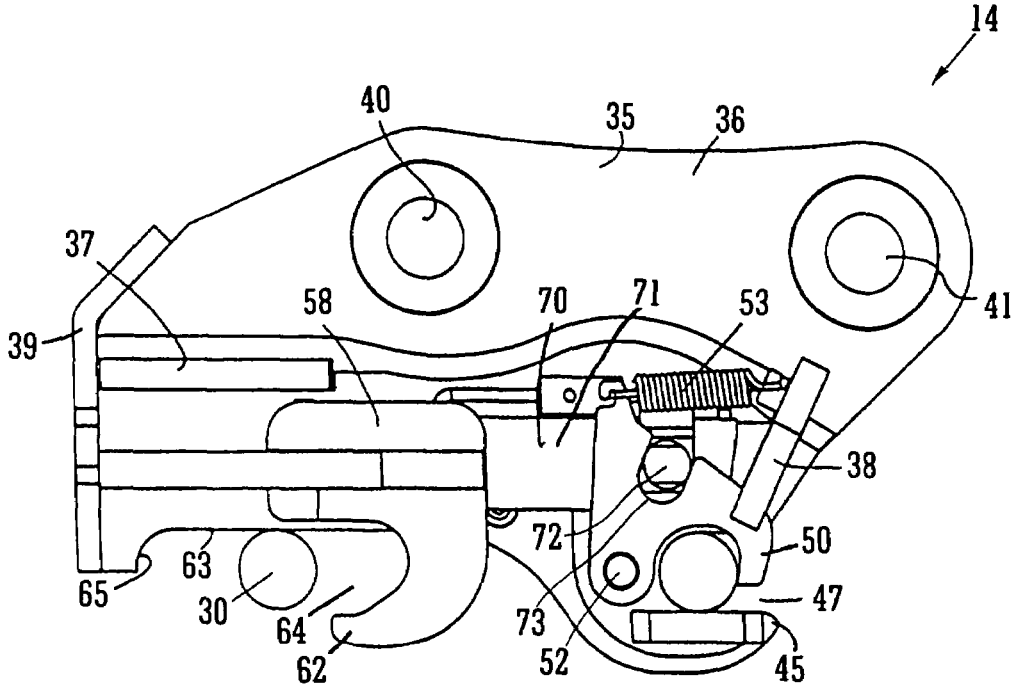
FIG. 6 is a side elevational view of a portion of the quick hitch coupler of FIG. 1.
Figure 7:
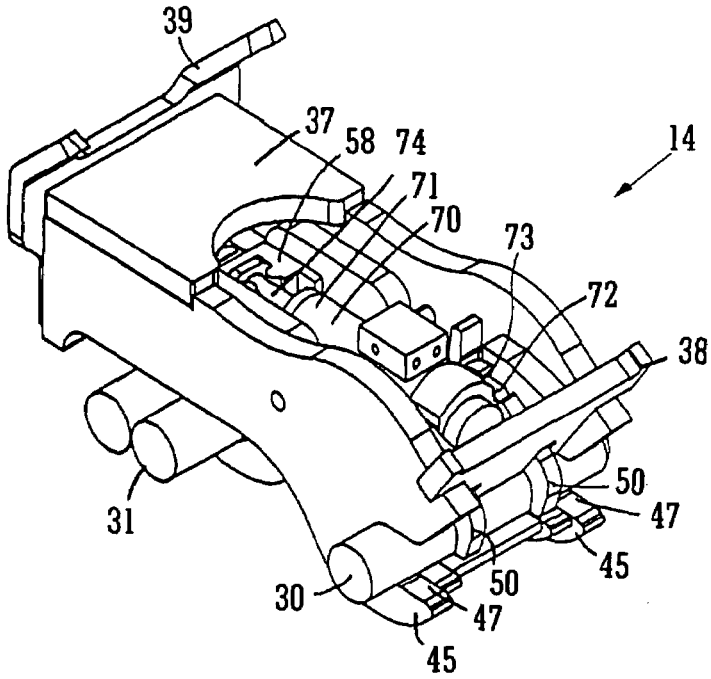
FIG. 7 is a perspective view of a portion of the quick hitch coupler of FIG. 1, FIGS. 8(*a*) to (*c*) are side elevational views of portions of the quick hitch coupler illustrating the quick hitch coupler in use.
Figure 8A:
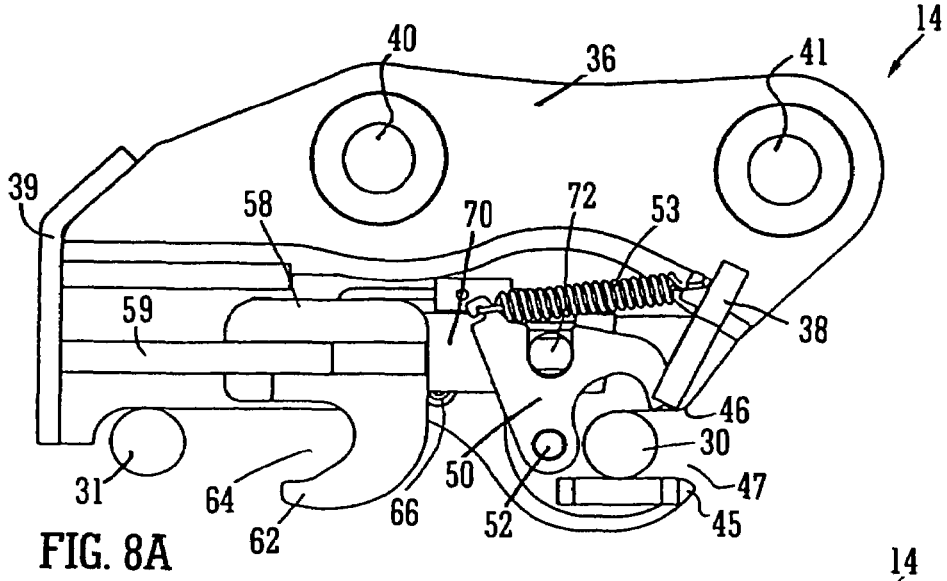
Figure 8B:
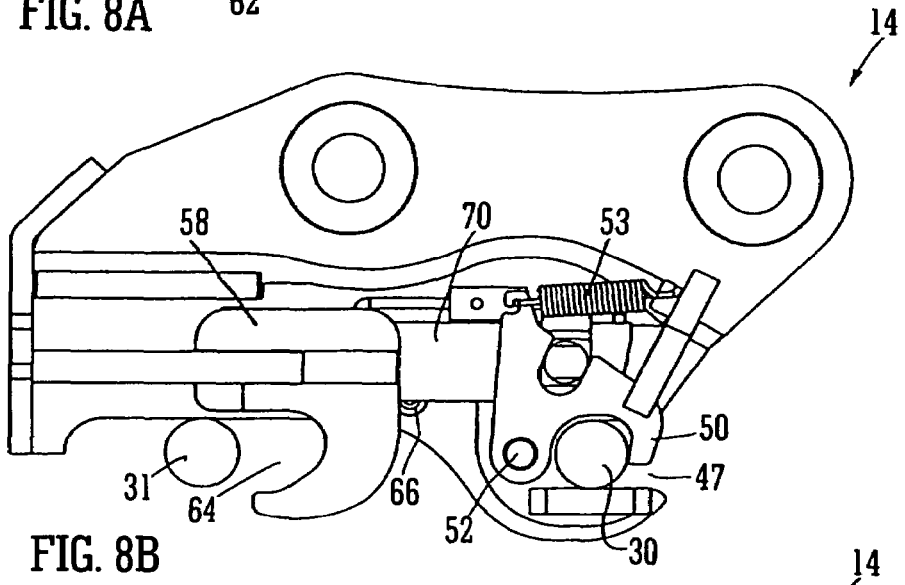
Figure 8C:
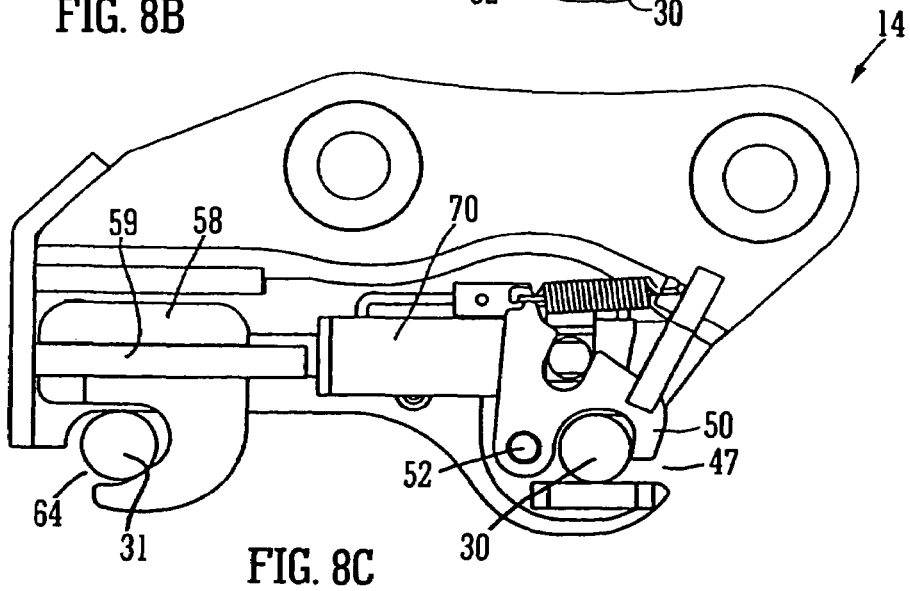
Figure 9:
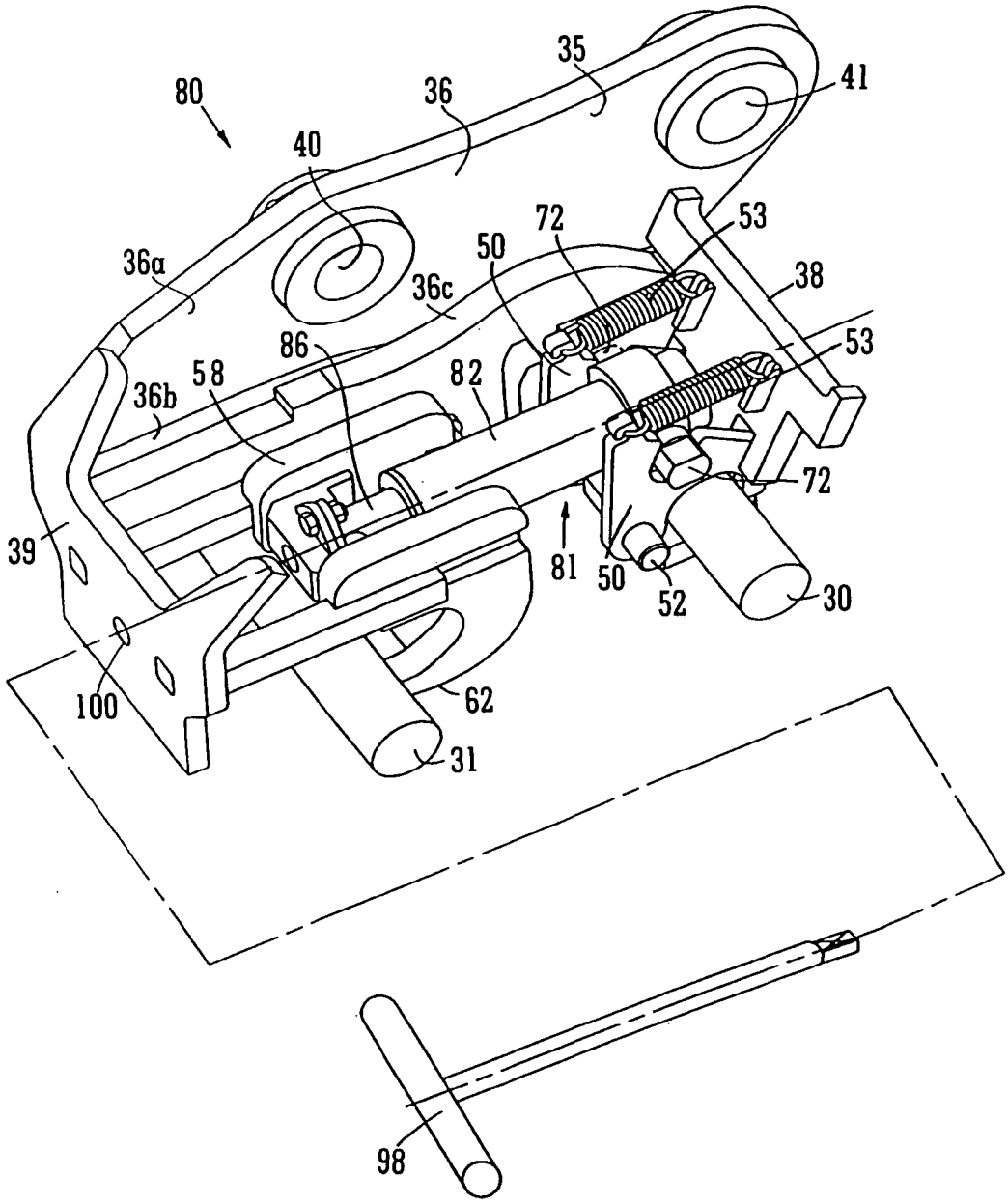
FIG. 9 is a perspective view substantially similar to FIG. 4 of a quick hitch coupler according to another embodiment of the invention.
Figures 10, 11, 12:
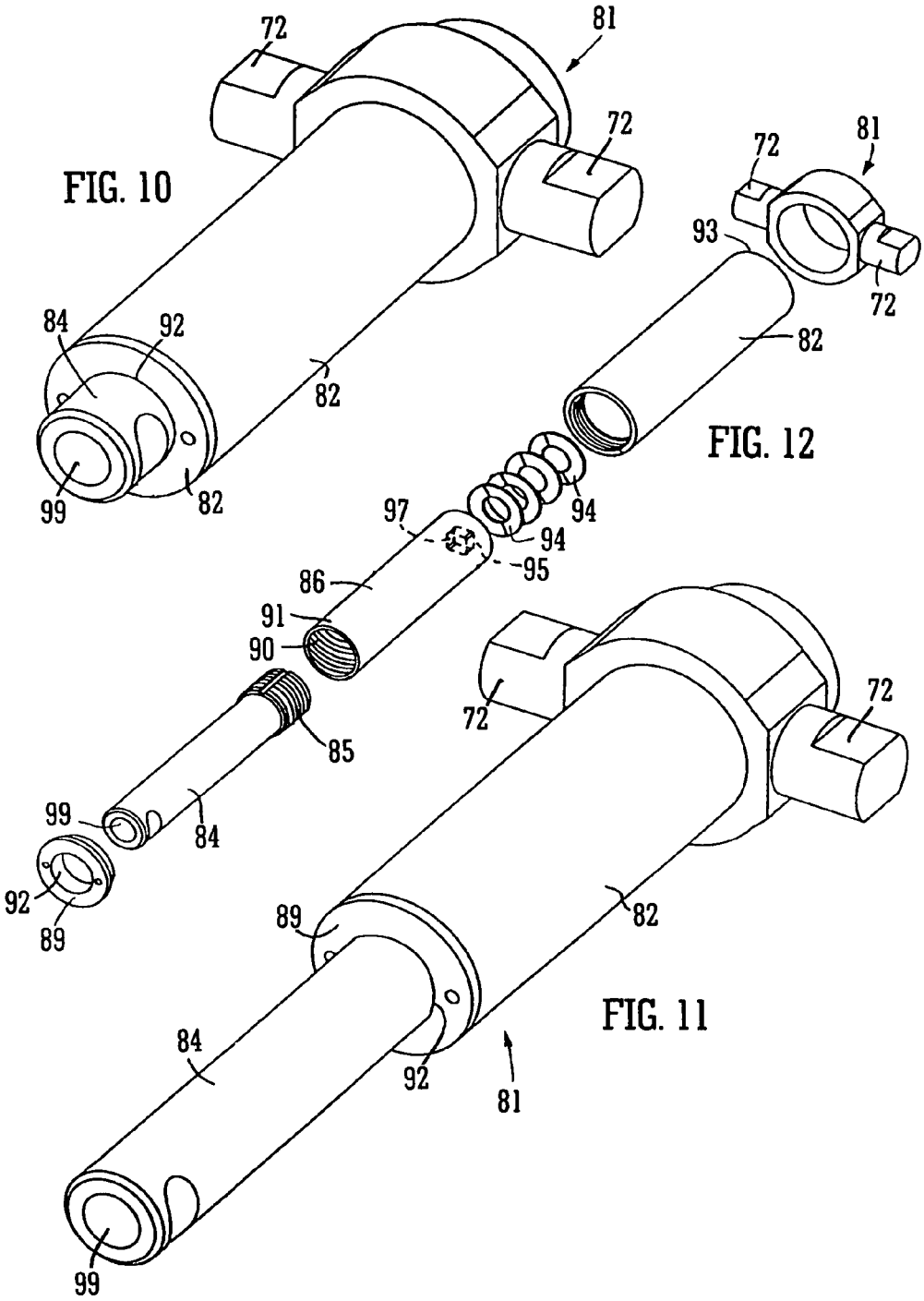
FIG. 10 is a perspective view of a portion of the quick hitch coupler of FIG. 9.
FIG. 11 is another perspective view of the portion of FIG. 10 illustrated in a different state.
FIG. 12 is an exploded perspective view of the portion of FIG. 10.

A moveable engaging means or engagement mechanism is provided by a moveable engagement member 58 is slideably carried in the body member 35, and is slideable between an engaged state illustrated in FIG. 3 for engaging the second coupling pin 31 of the bucket 12, and a disengaged state illustrated in FIG. 2 for disengaging the second coupling pin 31 for releasing the bucket 12 from the coupler 14. Guide tracks 59 mounted on the respective side plates 36 slideably engage corresponding guide grooves 60 on respective opposite sides of the engagement member 58 for guiding the engagement member 58 between the engaged and disengaged states with rectilinear motion. A jaw 62 extending from the engagement member 58 defines with adjacent edges 63 of the respective side plates 36 an open mouth 64 for accommodating the second coupling pin 31 into and between the jaw 62 and the edges 63 of the side plates 36. The open mouth 64 faces outwardly of the coupler 14 in a direction opposite to the direction in which the open mouth 47 defined by the fixed jaws 45 and 46 faces. Accordingly, when the moveable engagement member 58 is in the engaged state the first and second coupling pins 30 and 31 are securely engaged between the fixed jaws 45 and 46 and the engagement member 58 respectively.

An abutment means comprising respective abutment members 65 extend from the side plates 36 defining the spacing between coupling pins 30 and 31 of an accessory which can be accommodated by the coupler 1.

A limit means, namely, a pair of limit members 66 extend inwardly from the side plates 36 for defining a disengaged position of the engagement member 58 when the engagement member 58 is in the disengaged state, and for preventing further movement of the engagement member 58 in a direction from the engaged state to the disengaged state when the moveable engagement member 58 is in the engaged position.

A drive means comprising an hydraulically operated double acting coupler ram 70 acts between the moveable engagement member 58 and the latch 50 for urging the engagement member 58 between the engaged and disengaged states, and for moving the latches 50 between the latched and the unlatched states. The coupler ram 70 comprises a ram housing 71 and a piston rod 74 extending from the ram housing 71.

A pair of trunions 72 extending transversely from one end of the ram housing 71 slideably engage corresponding longitudinally extending guide grooves (not shown in this embodiment of the invention, but described in the embodiment of the invention which is described with reference to FIGS. 13 and 14) in the side plates 36 for facilitating longitudinal movement of the trunions 72, and in turn the ram housing 71 in the body member 35. The piston rod 74 is connected to the engagement member 58 for urging the engagement member 58 between the respective engaged and disengaged positions. The trunions 72 also engage corresponding slots 73 in the latches 50 for urging the latches 50 from the latched to the unlatched state against the action of the springs 53 after the engagement member 58 has been urged by the ram 70 from the engaged to the disengaged state. Accordingly, the ram 70 co-operates between the engagement member 58 and the latches 50 for respectively operating the engagement member 58 and the latches 50.

The tension in the tension springs 53 is sufficiently strong for retaining the latches 50 in the latched state unless they are positively urged from the latched state by the ram 70. Accordingly, the ram 70 co-operates with the tension springs 53 and the limit members 66 for controlling operation of the latch 50. Thus, when the engagement member 58 is in the engaged position engaging the second coupling pin 31 of the bucket 12, and the fixed jaws 45 and 46 are engaging the first coupling pin 30, and the piston rod 74 is extended from the ram housing 71, thereby retaining the engagement member 58 in the engaged position and the latches 50 in the latched position. In order to release the bucket 12 from the coupler 14, the ram 70 is initially operated for retracting the piston rod 74 into the ram housing 71. Because of the strong tension in the tension spring 53 the initial retraction of the piston rod 74 into the ram housing 71 urges the engagement member 58 from the engaged to the disengaged position until it abuts the limit member 66. At that stage further movement of the engagement member 58 is no longer possible, and thus further retraction of the piston rod 74 into the ram housing 71 causes the latches 50 to be pivoted from the latched to the unlatched state, thus permitting disengagement of the first coupling pin 30 through the open mouth 47. For so long as the piston rod 74 is fully retracted within the ram housing 71, the engagement member 58 is held in the disengaged state and the latches 50 are held in the unlatched state. Initial movement of the piston rod 74 outwardly of the ram housing 71 causes the latches 50 to be urged from the unlatched to the latched state by the tension springs 53. Once the latches 50 are in the latched state, further outward movement of the piston rod 74 from the ram housing 71 causes the engagement member 58 to be urged from the disengaged position to the engaged state.

Accordingly, in use the quick hitch coupler 14 is initially connected to the mounting linkages 22 and the dipper arm 10 by the first and second connector pins 25 and 28, respectively. The ram 70 is appropriately connected to an hydraulic fluid supply of the apparatus 1 for operating the ram 70. With the piston rod 74 of the ram 70 in the fully retracted state, in other words, with the piston rod 74 fully retracted within the ram housing 71 the dipper arm 10 is operated for aligning the coupler 14 with the bucket 12 or other accessory to be attached to the dipper arm 10. With the ram 70 in the fully retracted state, and thus the moveable engagement member 58 in the disengaged state and the latches 50 in the unlatched state the coupler 14 is initially hitched to the first coupling pin 30 by engaging the first coupling pin 30 in the open mouth 47 defined by the fixed jaws 45 and 46. The coupler 14 is then pivoted around the second connector pin 28 and the first coupling pin 30 until the open mouth 64 defined between the engagement member 58 and the edges 63 of the side plates 36 is aligned with the second coupling pin 31. The ram 70 is then operated for urging the piston rod 74 outwardly of the ram housing 71. Initial movement of the piston rod 74 out of the ram housing 71 causes the latches 50 to be urged under the action of the tension springs 53 from the unlatched to the latched state thereby engaging around and retaining the first coupling pin 30 in the open mouth 47. Further outward movement of the piston rod 74 urges the moveable engagement member 58 into engagement with the second coupling pin 31 until the first coupling pin 30 is tightly engaged within the fixed jaws 45 and 46 and the second coupling pin 31 is tightly engaged by the jaw 62 of the engagement member 58. The bucket 12 is thus securely engaged on the coupler 14 and is operated by the dipper arm 10 in conventional fashion.

Removal of the bucket 12 from the coupler 14 is the reverse of engagement. Initially, the moveable engagement member 58 is urged from the engaged to the disengaged state by initial retraction of the piston rod 74 into the ram housing 71. Once the engagement member 58 abuts the limit member 66 further movement of the engagement member 58 is prevented and thus further retraction of the piston rod 74 into the ram housing 71 causes the latches 50 to be urged from the latched to the unlatched state. The coupler 14 can then be disengaged from the bucket 12.

If during operation of the apparatus 1 the hydraulic fluid supply to the ram 70 should fail, under the weight of the bucket 12 the coupling pin 31 bearing on the moveable engagement member 58 will in general urge the moveable engagement member 58 into the disengaged position abutting the limit member 66. This will allow the second pivot pin to disengage the coupler 14. However, the tension in the tension springs 53 is such as to continue retaining the latches 50 in the unlatched state, thereby preventing disengagement of the first coupling pin 30 from between the fixed jaws 45 and 46. Thus, even in the event of failure of the hydraulic fluid supply to the ram 70 there is no danger of the bucket 12 becoming detached from the coupler 14. The coupler 14 may comprise a safety check valve to prevent loss of hydraulic fluid from the ram 70 in the event of failure of the hydraulic fluid supply. However, even where such a safety check valve is provided, it is possible for the check valve and/or the hydraulic ram to be damaged, or suffer seal failure, and thus, the latches 50 retain the bucket or other accessory attached to the coupler, and in turn to the dipper arm in the event of such failure.

Figure 12A:
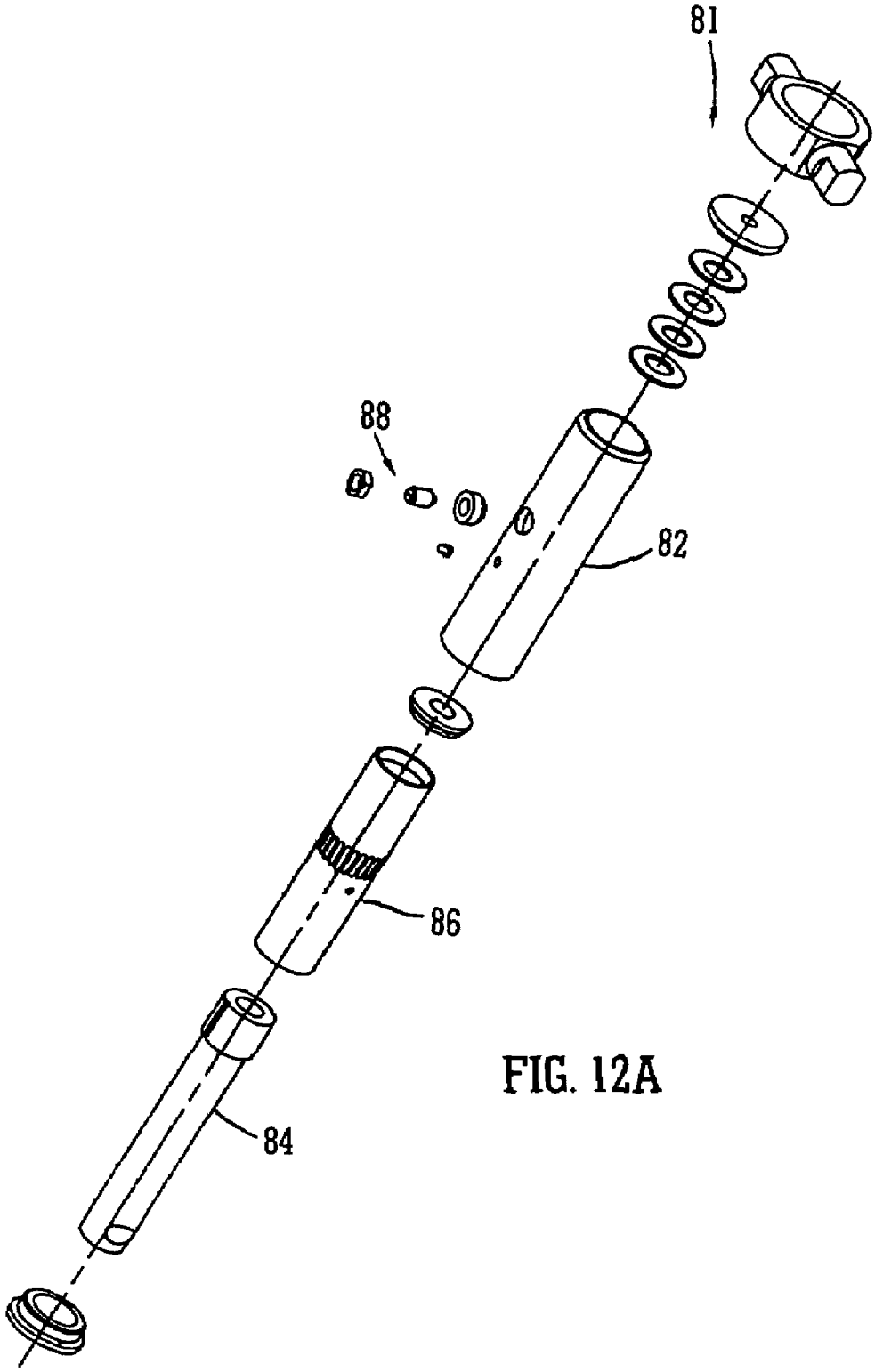
FIG. 12*a* is an exploded perspective view of another embodiment of a portion of a quick hitch coupler substantially similar to FIG. 9.

Referring now to FIGS. 9 to 12, there is illustrated a quick hitch coupler according to another embodiment of the invention indicated generally by the reference numeral 80. The quick hitch coupler 80 is substantially similar to the quick hitch coupler 14, and similar components are identified by the same reference numerals. The main difference between the quick hitch coupler 80 and the quick hitch coupler 14 is that the ram 70 of the quick hitch coupler 1 is replaced in the quick hitch coupler 80 by a manually operated screw drive mechanism which is indicated generally by the reference numeral 81. The screw drive mechanism 81 comprises an outer housing sleeve 82 which is trunion mounted in the body member 35 by a pair of trunions 72 similar to the trunions 72 of the quick hitch coupler 1. The trunions 72 of the quick hitch coupler 80 are similarly slideable in corresponding guide grooves (not shown) in the side plates 36. A shaft 84 which is connected to the moveable engagement member 58 in similar fashion as the piston rod 74 is connected to the engagement member 58 in the coupler 14 terminates in a threaded end 85 which engages a correspondingly internally threaded intermediate sleeve 86. The intermediate sleeve 86 is rotatably mounted within the housing sleeve 82 for in turn urging the shaft 84 inwardly and outwardly of the housing sleeve 82 for in turn urging the moveable engagement member 58 between the engaged and the disengaged position, and similarly for urging the latches 50 between the latched and the unlatched states against the actions of the springs 53 in similar fashion to that as already described with reference to the coupler 14. A threaded ferrule 89 engages internal threads 90 at an end 91 of the housing sleeve 82 for retaining the intermediate sleeve 86 within the housing sleeve 82. A bore 92 extending through the ferrule 89 slideably accommodates the shaft 84 through the ferrule 89. An end 93 of the housing sleeve 82 is closed by an end cap (not shown), and four compression disc springs 94 located in the housing sleeve 82 act between the end cap (not shown) of the housing sleeve 82 and the intermediate sleeve 86 for urging the intermediate sleeve 86 against the ferrule 89, and also for urging the internal threads of the intermediate sleeve 86 against the threads of the threaded end 85 of the shaft 84 for effectively securing the shaft 84 and the intermediate sleeve 86 in a desired relative position. Securing can also be achieved by a spring plunger 88 mounted through 82 and engaging in machined grooves cut radially about the body of the sleeve 86, as shown in the embodiment of FIG. 12*a*. An end cap 95 closes one end 96 of the intermediate sleeve 86, and a keyed opening provided by a square opening 97 is engageable by a T-bar key 98 through a bore 99 in the shaft 84 for rotating the intermediate sleeve 86 for in turn urging the shaft 84 inwardly and outwardly of the housing sleeve 82 for urging the moveable engagement member 58 between the engaged and disengaged states, and for urging the latches 50 between the latched and the unlatched states against the springs 53.

An opening 100 in the connector member 39 accommodates the key 98 into the bore 99 in the shaft 84 for in turn engaging the square opening 97 in the end cap 95 of the intermediate sleeve 86. Accordingly, in this embodiment of the invention the moveable engagement member is moveable between the engaged and the disengaged positions and the latches 50 are moved between the latched and the unlatched states manually by manual operation of the screw drive mechanism 81 by the key 98.

Otherwise, the coupler 80 and its operation is similar to that of the coupler 14.

Figure 13:
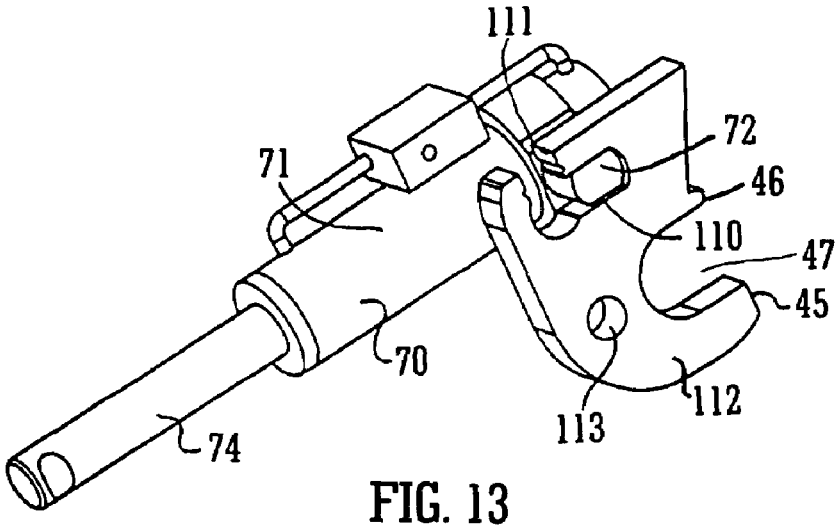
FIG. 13 is a perspective view of a portion of a coupler according to another embodiment of the invention.
Figure 14:
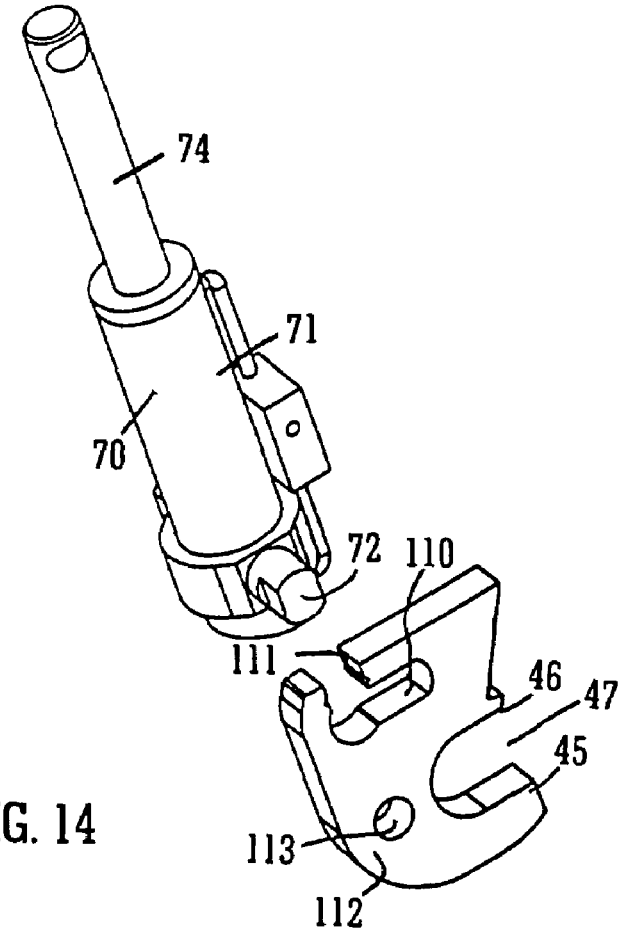
FIG. 14 is an exploded perspective view of the portion of FIG. 13.

Referring now to FIGS. 13 and 14, there is illustrated an hydraulic ram 70 and a portion of the trunion mounting 72 for mounting the ram 70 to the side plates 36 of a coupler (not shown) according to another embodiment of the invention. The coupler according to this embodiment of the invention is identical to that of FIGS. 2 to 8, with the exception that the trunion mountings 72 of the ram 70 slideably engage longitudinally extending guide grooves 110 which in this embodiment of the invention are formed in carrier plates 112, which are in turn welded to the side plates 36. A transversely extending entry slot 111 is provided to each guide groove 110 for facilitating entry of the corresponding trunion 72 into the guide groove 110. The advantage of providing the entry slots 111 to the guide grooves 110 is that they facilitate ease of assembly of the ram 70 into the coupler. The trunions 72 are initially entered into the entry slots 111 as illustrated in FIG. 14. The ram 70 is then pivoted through 90° so that the trunions 72 align with the guide grooves 110, and the piston rod 74 is then secured to the moveable engagement member 58.

Additionally, as well as the fixed jaws 45 and 46 being formed in the side plates 36, the fixed jaws 45 and 46 are also formed in the carrier plate 112. Bores 113 in the carrier plate 112 pivotally carry the pivot pins 52, which in this embodiment of the invention extend from the latches 50 for pivotally carrying the latches 50.

Otherwise, the coupler according to this embodiment of the invention and its operation is similar to that of the coupler of FIGS. 2 to 8.

While the couplers have been described as being provided with a pair of latches, any suitable number of latches may be provided, and indeed, in many cases a single latch may be sufficient.

It is also envisaged that other suitable moveable and fixed engaging means may be provided, and while it is advantageous that the open mouths defined by the respective engagement means face outwardly in directions opposite to each other, this is not essential, in certain cases, the open mouths of the moveable and fixed engaging means may face each other, or may face in the same direction parallel to each other.

While the drive means have been described as being provided by an hydraulic ram and by a screw drive mechanism, any other suitable drive means may be provided, for example, a pneumatic ram, or indeed, in certain cases, a linear drive, for example, a power driven liner screw drive mechanism may be provided.

While the urging means for urging the latches into the unlatched state have been described as being tension springs, any other suitable urging means may be provided, for example, compression springs or spring, a leaf spring or springs, a torsion spring, and indeed, a single tension spring may be sufficient.

Another aspect of the invention is a control system for a coupler. The control system may be used with any type of known coupler. This includes couplers that are fitted with latches to prevent the disengagement of an attachment from the coupler should the hydraulic fluid supply to the coupler ram fail, and also couplers that are not fitted with such safety latches. The control system of the invention will now be described with reference to the coupler of FIGS. 1 to 14.

Figure 15:
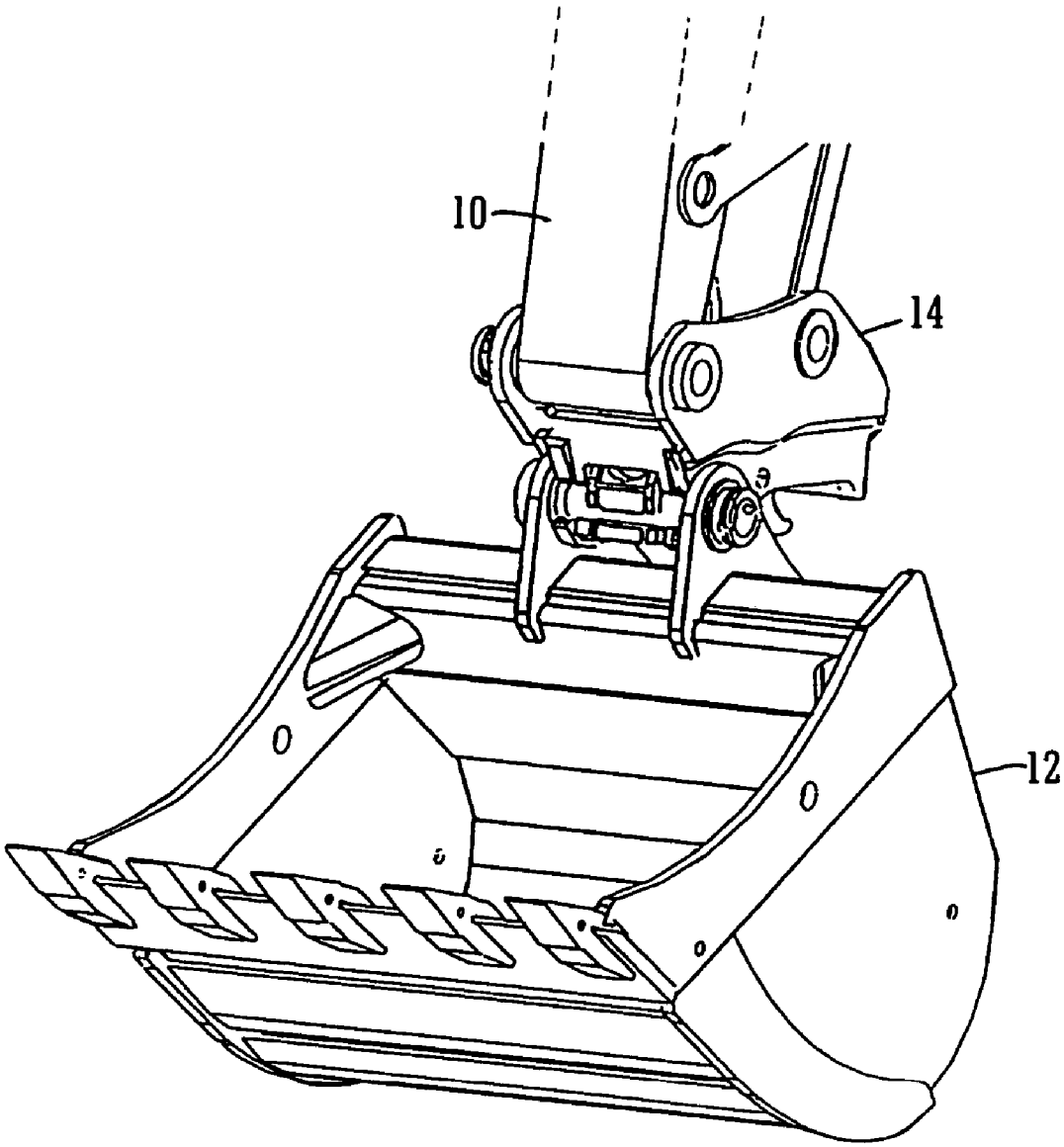
FIG. 15 is a perspective partial view showing the coupler of FIG. 2 fitted to the dipper arm of the earth working apparatus; the arm and the coupler being in relative position in which the control system of the invention does not allow the engagement member to be actuated to a disengaged state in which an attachment (bucket) is removable from the coupler.

The control system of the invention controls the operation of the moveable engagement member 58 of the coupler 14. In the configuration of FIG. 15 the latches 50 are closed over the coupling pin 31, preventing the bucket from being released. The relative orientation of the arm 8 (in particular the dipper arm 10) and the coupler 14 are such that if the front pin lock is open bucket 12 can fall from the coupler 14. It is a feature of the control system of the present invention that it will not allow the engagement member to be actuated to a release or disengaged position when in such a position.

Figure 16:
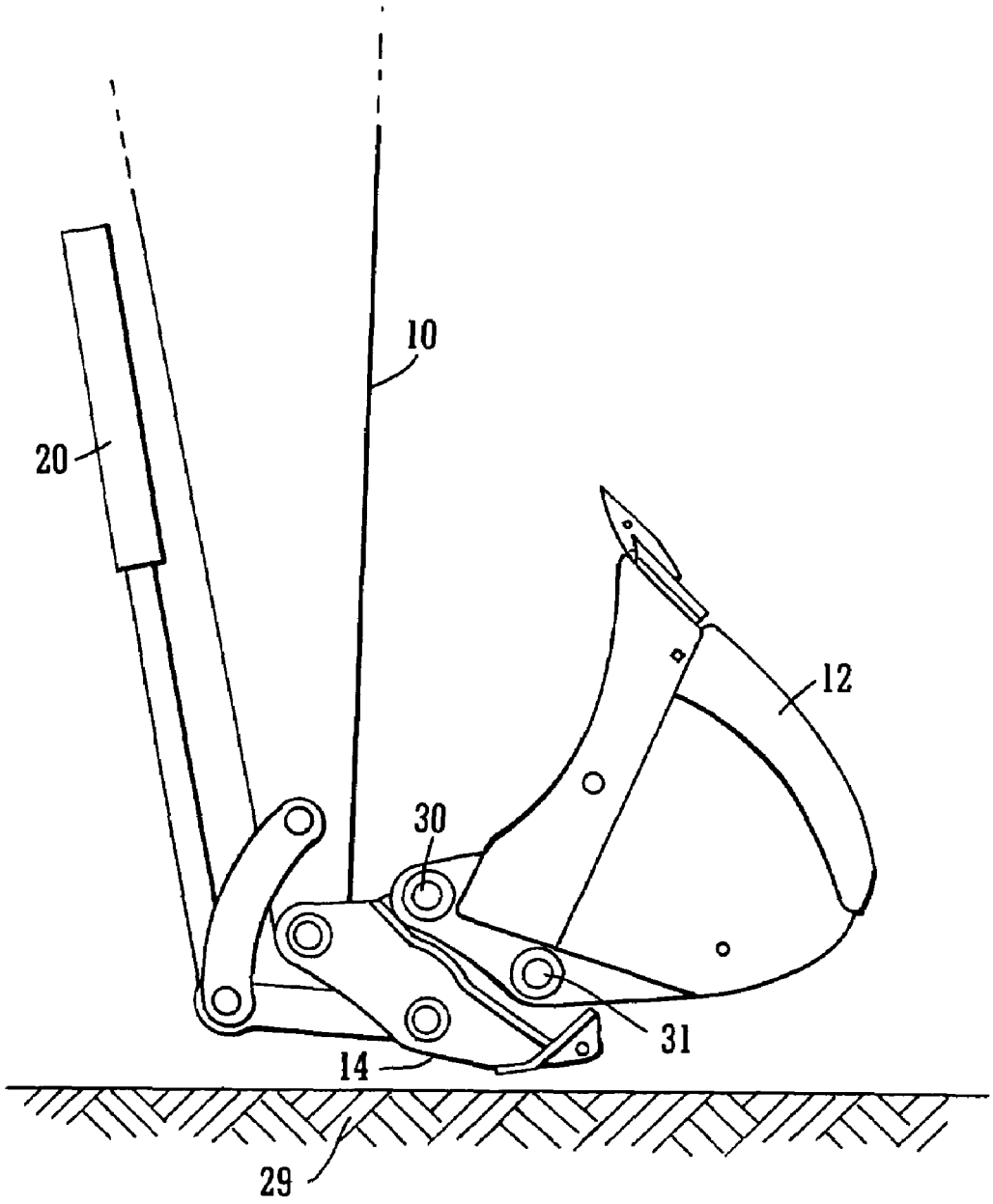
FIG. 16 is a perspective partial view showing the coupler of FIG. 2 fitted to the dipper arm of the earth working apparatus, the arm and the coupler being in a selected relative position in which the control system of the invention allows the engagement member to be actuated to a disengaged state so that an attachment (bucket) is removable from the coupler.

FIG. 16 shows a partial view of part of the dipper arm 10 with the coupler 14 attached thereto. In the relative orientation of the arm 8 (in particular the dipper arm 10) and the coupler 14, shown the bucket 12 cannot fall from the coupler 14. In particular the pin 30 is retained within the jaw 45 and even though pin 31 is released from jaw 62 the bucket 12 is safely held in place and will not automatically fall from the arm. This is an important advantage of the control system of the present invention in that it will only allow the engagement member to be actuated to a release position when in such a position. In particular it is to be noted from FIG. 16 that the crowd ram 20 is in the fully extended position (the bucket 12 is tucked into the arm). As shown in FIG. 16 also it is desirable that the release of the attachment occurs on or close to the ground level 29.

The control system for controlling the engaging and disengaging actions of the coupler 14 will be described now with reference to FIGS. 17-20. The control system is adapted to provide a safety mechanism which prevents the hydraulic ram 70 to the coupler 14 from operating so as to disengage the coupling pins 30, 31 of the attachment from their locked position when the open jaw 45 of the coupler 14 is facing downwards.

Figure 17:
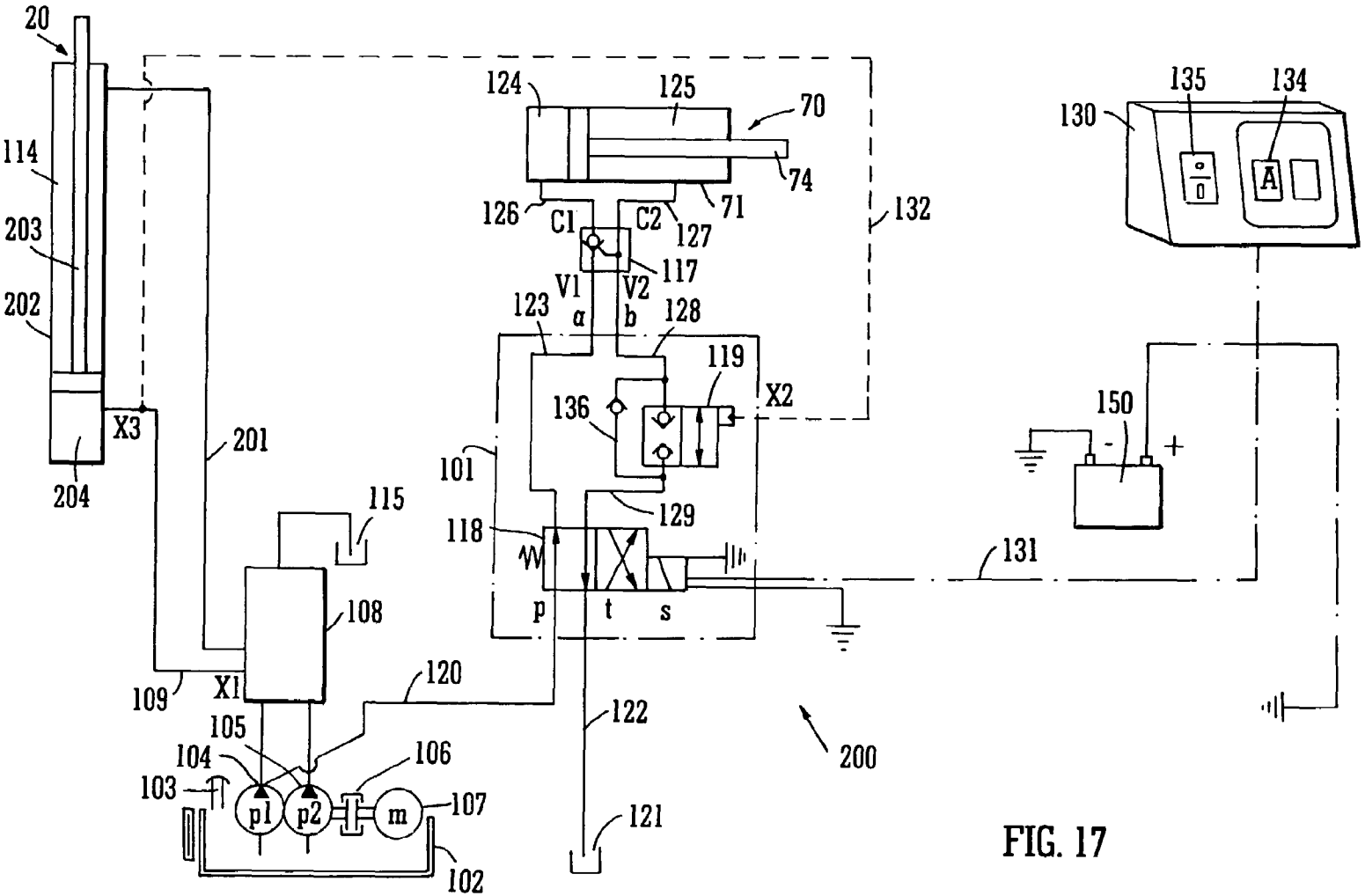
FIG. 17 is a diagrammatic representation showing hydraulic and electrical circuits forming part of a control system of a first embodiment of the control system of the present invention; the control system configured to select the engaged state of the engagement mechanism.
Figure 18:
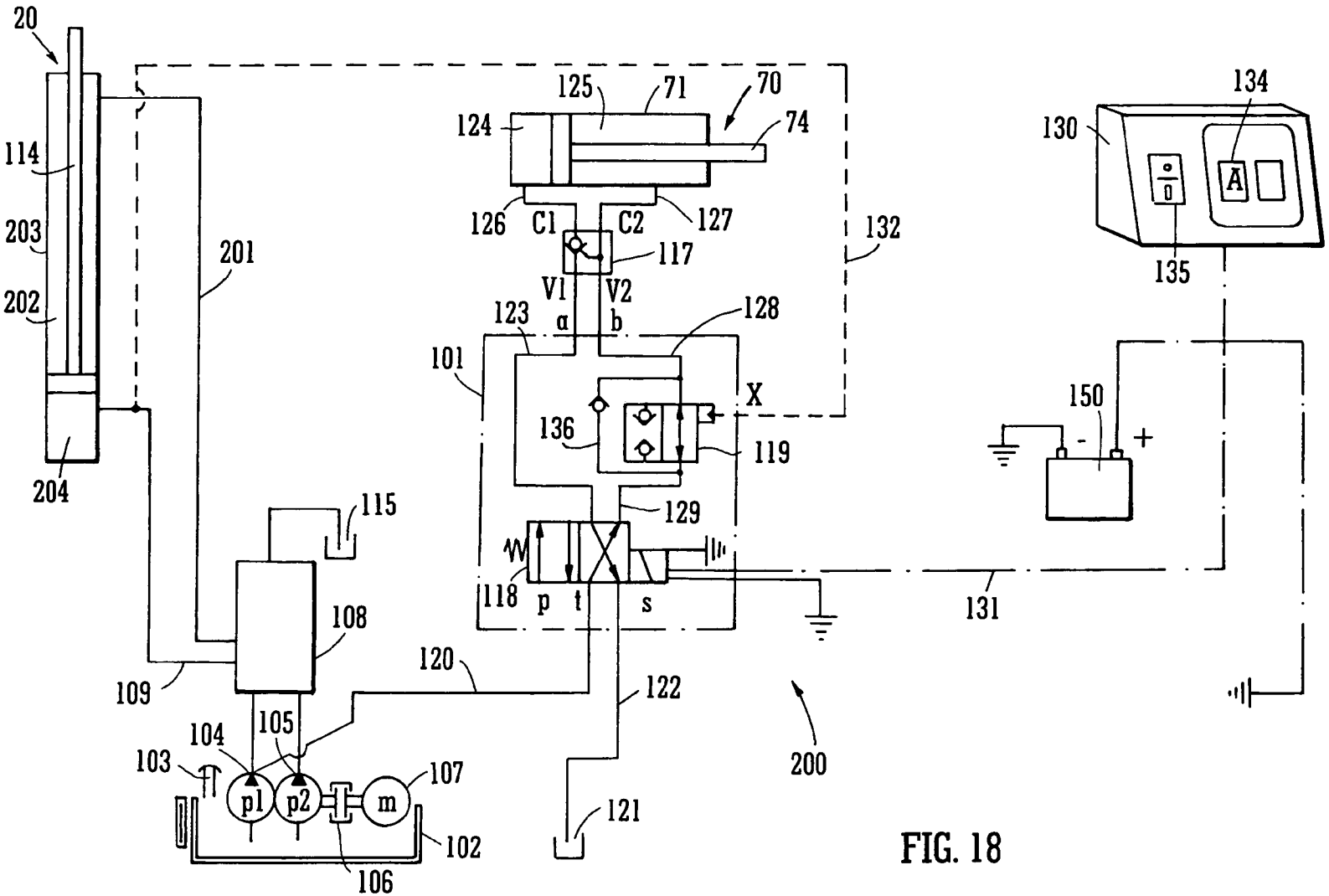
FIG. 18 is a diagrammatic representation showing hydraulic and electrical circuits forming part of a control system of a first embodiment of the control system of the present invention; the control system configured to select the disengaged state of the engagement mechanism.

FIGS. 17 and 18 show one embodiment of the control system of the invention. These figures are diagrammatic representations showing hydraulic and electrical circuits forming part of a control system of a first embodiment of the control system of the present invention. In FIG. 17 the control system 200 is configured to select the attachment engaging position or the engaged state of the engagement member 58, while in FIG. 18 the control system 200 is configured to select the attachment release position or the disengaged state of the engagement member 58.

The main components of the control system 200 include a control console 130, and a valve system 101. The valve system 101 can be considered to be a solenoid operated directional control logic valve. The solenoid operated directional control valve 101 comprises a 4 port 2 position solenoid operated spring return valve 118 and a sensor in the form of a pressure sensitive valve 119. A pilot operated check valve 117 is provided to prevent flow of oil out of the coupler ram 70 in the event of a pressure drop in the system, for example a burst pipe etc.

A main oil reservoir 102 holds the oil required for operating the hydraulic rams of the machine. There is a breather 103 and a motor 107 which is coupled by a coupling 106 to two oil pumps 104 and 105. Pumps 104 and 105 are the main source of hydraulic pressure in the machine's system and in particular pump oil to the valve block 108. The valve block 108 represents the main valve controls which are operated by levers by the operator to control the rams for moving the arm 8 or the machine itself.

The bucket crowd ram 20 comprises a ram housing 202 and a piston rod 203 extending from the ram housing 202. Hydraulic lines 109 and 201 respectively provide the flow of oil in to and out of each end of the bucket crowd ram housing 202. The ram housing comprises a bore area 204 located at one side of the piston rod 203 and an annulus area 114 located at the other side of the piston rod 203. The direction of the oil flow through the hydraulic lines 109 and 201 is dictated by whether the control (on the valve block 108) for the bucket crowd ram 20 is set for it to instroke or outstroke.

When the bucket crowd ram 20 is set to outstroke, typically pump 104 pumps oil through the high pressure hydraulic line 109 into the bore end 204 of the bucket crowd ram housing 202. As the oil pressure increases, the piston rod 203 is gradually urged toward its extended position. This outstroking of the piston rod 203 causes the oil in the annulus area 114 of the bucket crowd ram housing 202 to be pushed into the (return) hydraulic line 201, through the valve block 108 and is returned to the oil reservoir 115. In practice the oil reservoir 115 will be the oil reservoir 102. Conversely, when the bucket crowd ram 20 is required to instroke the oil direction is reversed.

The hydraulic operation of the coupler ram 70 is controlled by a solenoid operated directional control logic valve 101. As stated above the solenoid operated directional control valve comprises a 4 port 2 position solenoid operated spring return valve 118 and a pressure valve 119. The pressure valve 119 only opens when a certain pressure is detected in line 132. When the valve 119 is closed, oil flowing towards the 4 port 2 position solenoid operated spring return valve 118 bypasses the valve 119 by flowing through the hydraulic line 136. Pump 104 supplies the oil from the main reservoir 102 to the 4 port 2 position solenoid operated spring return valve 118 via a high pressure hydraulic line 120. The return path for the flow of oil from the 4 port 2 position solenoid operated spring return valve 118 to an oil reservoir 121 is provided by the hydraulic line 122.

Another high pressure hydraulic line 123 connects the 4 port 2 position solenoid operated spring return valve 118 to the pilot operated check valve 117. The pilot operated check valve 117 is connected to the bore area 124 and annulus area 125 of the coupler ram housing 71 by the high pressure hydraulic lines 126 and 127 respectively. The pilot operated check valve 117 is also connected to the pressure valve 119 by the hydraulic line 128. The connection between the pressure valve 119 and the 4 port 2 position solenoid operated spring return valve 118 is represented by the hydraulic line 129. It will be appreciated that the hydraulic lines are represented diagrammatically to show hydraulic fluid communication rather than the exact physical configuration of the system, for example valves 118 and 119 could be formed in one unit.

The 4 port valve 118 controls the direction of the flow of oil to and from the coupler ram 70. The control signal for this valve is an electrical signal from the control console 130.

An electrical connection 131 connects the 4 port valve 118 to the control console 130. The control console 130 may be located remotely from the hydraulic control circuit, preferably on the excavator cab side window. A battery 150 powers the control console 130. On (sequential) depression of two switches 134,135 on the control console 130 (the switches may be on a timed interval so that the activation signal is ineffective unless the switches are both pressed within a set period one from another), an electrical signal is transmitted by connection 131 to open a valve in the 4 port valve 118. Oil is then pumped (from pump 104) to flow through the 4 port valve 118 to the pressure valve 119 via the hydraulic line 129. This is the first of a number of conditions which must be met before the hydraulic coupler ram 70 can move the engagement member 58 to the release position (as described above).

The pressure valve 119 controls the flow of oil to the coupler ram 70. The control signal for the valve is a pressure control signal received through hydraulic line 132. In the embodiment the hydraulic signal is taken from line 132 which is branched from the hydraulic line 109 which provides the path for the flow of oil to and from the bucket crowd ram 20. This allows the pressure in line 109 to be transmitted through line 132 to the pressure valve 119.

The default position (shown in FIG. 17) of the coupler ram 70 is for the ram 70 to receive hydraulic pressure to urge it towards its maximum extended (outstroke) position. As described above the hydraulic coupler ram 70 will in its extended position hold the coupler 14 with the engagement member 58 in the engaged state (see FIG. 3 above).

In this default position the pump 104 pumps oil from the main reservoir 102 through the hydraulic line 120 into the 4 port valve 118. The oil then flows through the 4 port valve 118 and through to the pilot check valve 117 via the hydraulic line 123. The oil passes through the check valve 117 into the bore area 124 of the coupler ram housing 71 via the hydraulic line 126. This flow of oil into the coupler ram housing 71 urges the piston rod 74 towards the extended position.

This urging of the piston rod 74 outwards forces the oil in the annulus area 125 of the ram housing 71 to flow into the hydraulic line 127 to the pilot operated check valve 117. The oil passes through the check valve 117 and bypasses the pressure valve 119 by flowing via the hydraulic lines 128 and 136. The oil then flows through the hydraulic line 129 to the 4 port valve 118. Finally the oil flows from the valve 118 into the hydraulic line 122 where it is fed back into the oil reservoir 121. Again reservoir 121 and oil reservoir 102 will normally be one and the same.

In order to release the attachment from the coupler 14, the engagement member 58 must be moved from its engaged to disengaged position by action of an instroke of the coupler ram 70. FIG. 18 shows the configuration of the control system 200 required to set the ram 70 to instroke (release an attachment on the coupler 14).

The control system 200 requires the presence of two conditions before the ram 70 is enabled to perform an instroke. The first condition required is the activation signal originating from the control console 130.

The second condition to be met is that the pressure signal in the line 132 is such that it activates pressure valve 119. When the required signal is received the valve 119 moves to the position shown in FIG. 18 reversing the direction of hydraulic fluid flow to the ram 70. The required pressure signal is generated when the pressure in the hydraulic line 132 exceeds a specific value, typically of the order of 300 bars SI Units. The pressure selected is desirably a pressure threshold that is exceeded only after the pressure in the line has fully outstroked the crowd ram 20 and increased pressure results due to the fact that pressure builds up further as the ram 20 is at the limit of its extension. When the pressure valve 119 receives this signal, the valve is opened to allow the flow of oil through it to the pilot operated check valve 117. The oil then flows into the annulus area 125 of the coupler ram housing 71, thus enabling the ram 70 to be instroked. Of course ram 70 will only receive pressurized hydraulic fluid through lines 128 and 127 if valve 118 has already been activated to allow oil from line 120 to 129 (as is shown in FIG. 18).

It will be appreciated that activation alone of valve 119 or valve 118 is not by itself sufficient to achieve the release of an attachment by the coupler 14. Both must be activated at the same time. This means that it is unlikely that the operator of the machine could inadvertently release the attachment. Even if the attachment is inadvertently released it will only happen in selected relative positions of the attachment and the arm. It is a further advantage of the control system of the present invention that the attachment will not automatically fall from the coupler, but will remain partially held by the coupling as described above.

After activation of the release mechanism the system will return to the default position where only valve 118 need be operated to close the coupler again on an attachment.

Accordingly when it is required to operate the coupler ram 70 to disengage the attachment from the coupler 14 i.e. to instroke the coupler ram 70, the two activation signals must be present. The generation of these signals is enabled through the actions of an operator.

The operator must first operate a lever so as to outstroke the bucket crowd ram 20. This pressure from the maximum outstroke of the bucket crowd ram 20 feeds to the pressure valve 119 to activate the signal to enable the flow of oil through the valve towards the pilot operated check valve 117. Once the bucket crowd ram 20 is fully outstroked, the operator should then depress the two control switches 134 and 135 on the control console 130 (as above) to generate the electrical signal so as to activate the signal which reverses the direction of flow through the 4 port valve 118. This signal allows the pump 104 to pump oil through the hydraulic line 120 out through the valve 118 and then through the hydraulic line 129 to the directional control valve 119. As the directional control valve 119 is now open, oil may flow up through the hydraulic line 128 to the pilot operated check valve 117 and into the coupler ram 70 via the hydraulic line 127. This flow of oil into the annulus area 125 of the coupler ram housing 71 urges the piston rod 74 back into the ram housing 71. The oil contained in the bore area 124 of the ram housing 71 is then pushed into the hydraulic line 126 and flows to the check valve 117. As the pressure on the hydraulic line 128 is sufficiently high the check valve 117 is in the open position, allowing oil to flow through it to the hydraulic line 123 into the 4 port 2 position solenoid operated control valve 118 and finally back to the oil reservoir 121 via the hydraulic line 122. Again, as the piston rod 74 of the ram coupler 70 is connected to the engagement member 58 of the coupler 14, this process of operating the coupler ram 70 as described above results in the movement of the engagement member 58 so as to disengage the coupling pins 30, 31 of the attachment from the locked position.

Figure 19:
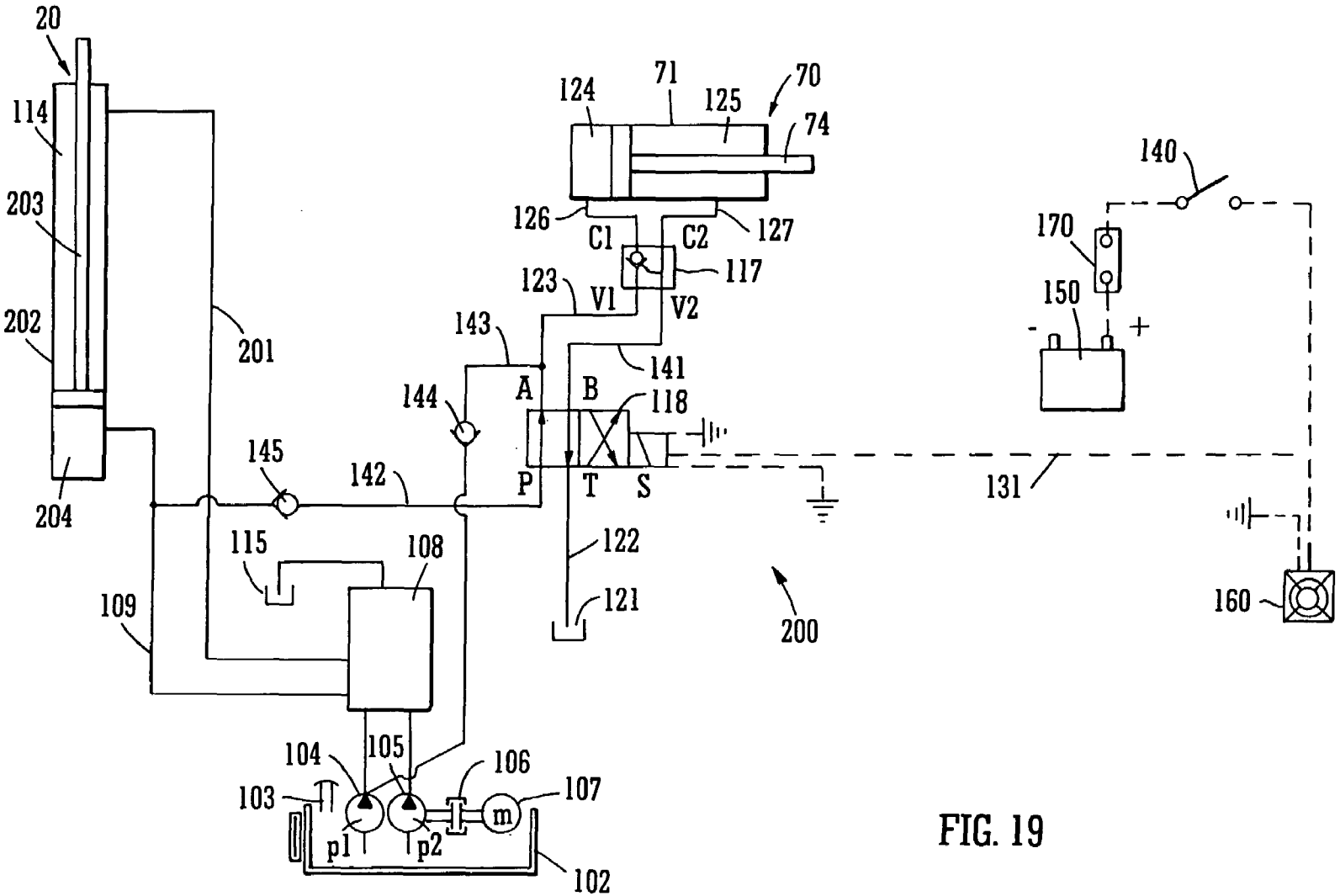
FIG. 19 is a diagrammatic representation showing hydraulic and electrical circuits forming part of a control system of a second embodiment of the control system of the present invention; the control system configured to select the engaged state of the engagement mechanism.
Figure 20:
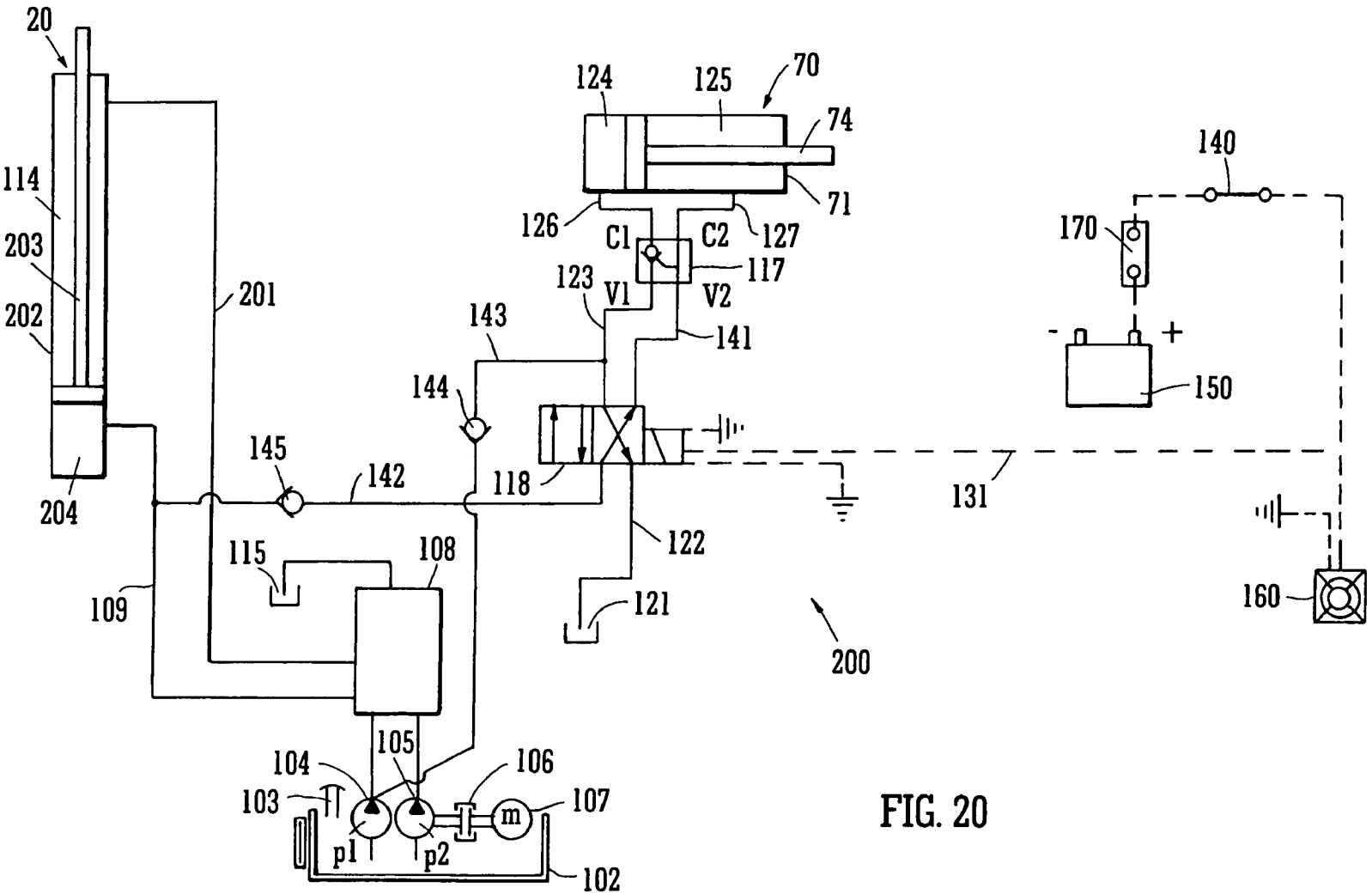
FIG. 20 is a diagrammatic representation showing hydraulic and electrical circuits forming part of a control system of a second embodiment of the control system present invention; the control system configured to select the disengaged state of the engagement mechanism.

A second embodiment of the control system 200 is illustrated in FIGS. 19 and 20. This embodiment is similar to the preferred embodiment, but without the inclusion of the pressure control valve 119. The same reference numerals have been used to identify the components that are the same as in the previous embodiment.

The hydraulic line 141 now connects the pilot operated check valve 117 directly with the 4 port valve 118. A hydraulic line 142 branches off the hydraulic line 109 and connects to the 4 port valve 118. This hydraulic line 142 has a valve 145. Another hydraulic line 143 now connects the pump 104 with the hydraulic line 123. This hydraulic line 143 has a valve 144. The control console of the previously described embodiment is now replaced in this embodiment with a simple on/off switch 140 (however it will be appreciated that a control console 130 such as that provided in the previous embodiment could also be used). A buzzer 160 is connected to the switch 140 which sounds when the switch 140 is in the on position. A fuse 170 is connected to the power supply 150. Similarly to the previous embodiment, the default operation for the coupler ram 70 is to be clamped in the outstroke position, corresponding to when the engagement member 58 is in the attachment engaging position.

In FIG. 19 the pump 104 pumps the oil from the reservoir 102 via the hydraulic lines 143 and 123 to the pilot operated check valve 117. The oil passes through valve 117 and into the bore area 124 of the coupler ram housing 71 via the hydraulic line 126. The pressure forces the oil contained in the annulus area 125 of the coupler ram housing 71 to flow through the hydraulic line 127 to the pilot operated check valve 117. The oil then continues through this valve 117 into the hydraulic line 141 to the 4 port valve 118. The oil then finally flows through line 122 into reservoir 121.

According to this embodiment of the present invention, the control system 200 responsible for the operation of the engagement member 58 to release the attachment from the engaged position is configured so that the coupler ram 70 can only begin to instroke on reception of two activation signals (or when two conditions are met). One activation signal (condition) is generated by the closing of the on/off switch 140. On closing the switch, a signal is received by the 4 port valve 118. This signal results a reversal of the flow of oil through the ports of the valve 118 as shown in FIG. 20.

The second activation condition or signal is a pressure signal. The pressure generated in hydraulic line 141 must be great enough to cause the check valve 117 to open to allow the return of oil from the bore area 124 of the ram housing 71 through line 126 and into the reservoir 121. In particular the hydraulic pressure in the line 141 will reach a sufficiently high pressure to operate the valve 117 when the bucket crowd ram 20 is fully outstroked. The check valve 117 then opens to allow return of hydraulic fluid as described above when the pressure in the line 141 is sufficiently high. The determination of the value of the incoming pressure is taken from line 142.

The opening of the check valve 117 allows oil to flow from the bore area 124 of the coupler ram housing 71 back to the 4 port valve 118. The valve 117 may for example be configured so that it requires a pressure of a least a third of the system pressure to affect its opening. In order to achieve a pressure valve of this magnitude, it is necessary to build up the pressure in the hydraulic line 109. This typically occurs when the bucket crowd ram 20 is in the fully outstroked position.

As in the case of the preferred embodiment, to operate the instroking of the coupler ram 70 the operator must close the on/off switch 140 to cause the (4 port) valve 118 to switch to the position shown in FIG. 20. The lever to outstroke the bucket crowd ram 20 must be operated at the same time and in particular towards full oustroking so that sufficient pressure builds up in the hydraulic line 141 to act as an activation signal to open the check valve 117 once a third of the system pressure is reached. This causes the oil to pump through the hydraulic line 142 into the 4 port valve 118.

It then flows to the pilot operated check valve 117 via the hydraulic line 141. With the check valve now open it flows into the annulus area 125 of the coupler ram housing 71. This forces the piston rod 74 into the ram housing. The oil in the bore area 124 is pushed out into the hydraulic line 126, and through the open check valve 117. It then passes via the hydraulic line 123 to the 4 port valve 118, and from there into the oil reservoir 121 via the hydraulic line 122. Oil from the pump 104 returns to the reservoir 121 via line 143 and 122 due to the switching of the valve 118.

Figure 21:
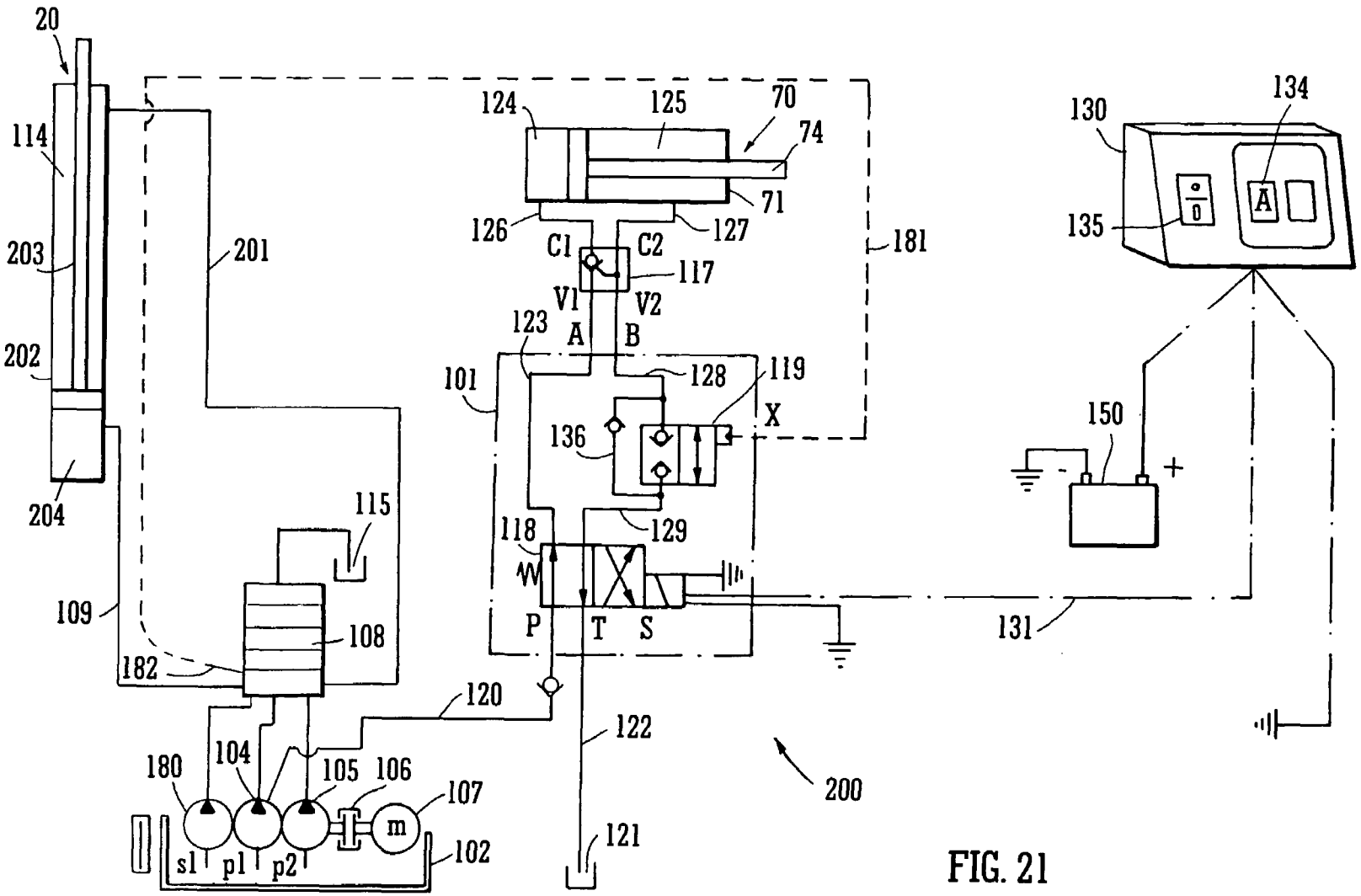
FIG. 21 is a diagrammatic representation showing hydraulic and electrical circuits forming part of a control system of a third embodiment of the present invention; the control system configured to select the engaging position of the engagement mechanism.
Figure 22:
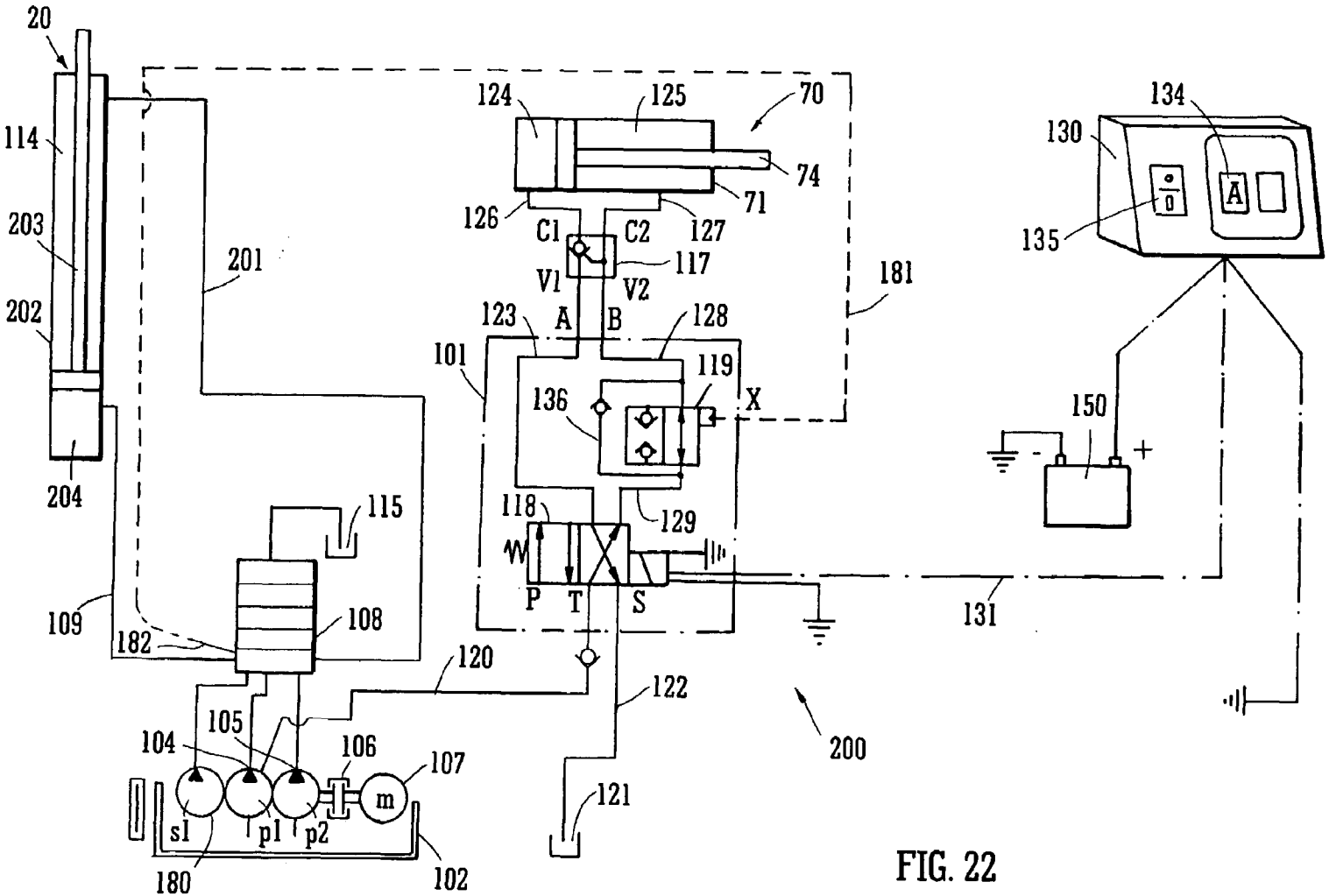
FIG. 22 is a diagrammatic representation showing hydraulic and electrical circuits forming part of a control system of a third embodiment of the present invention; the control system configured to select the disengaging position of the engagement mechanism.

A third embodiment of the control system is shown in FIGS. 21 and 22. FIG. 21 shows the circuit when the control system is set to outstroke the coupler 14 and FIG. 22 shows the circuit when the control system is set to instroke the coupler. This embodiment is similar to the preferred embodiment, with the same reference numerals being used to identify the components that are the same. In this embodiment the circuit makes use of the servo or low pressure pump 180 that is typically part of the hydraulic system of such excavator machines. This servo pressure increases when an excavator operator operates the levers so as to outstroke the crowd ram. The circuit then generates the pressure feed signal 181 to the logic valve 119 from the pressure at the crowd ram servo outstroke port 182 located on the excavator control valve block 108, rather than from the outstroke hydraulic line 109 of the bucket crowd ram 20.

In this embodiment, the pressure in the servo outstroke port 182 of the excavator control valve block 108 acts as an activating signal to open the valve 119 for the commencement of the instroking of the coupler ram 70. The pressure threshold required to activate the opening of the valve 119 is desirably selected to be the pressure at the servo outstroke port 182 when the bucket crowd ram 20 is fully outstroked. As in the previous embodiments, the two activation signals must occur at the same time in order to successfully instroke the coupler ram 70. The position of the valves when the control system is activated to instroke the coupler is shown in FIG. 22.

Figure 23:
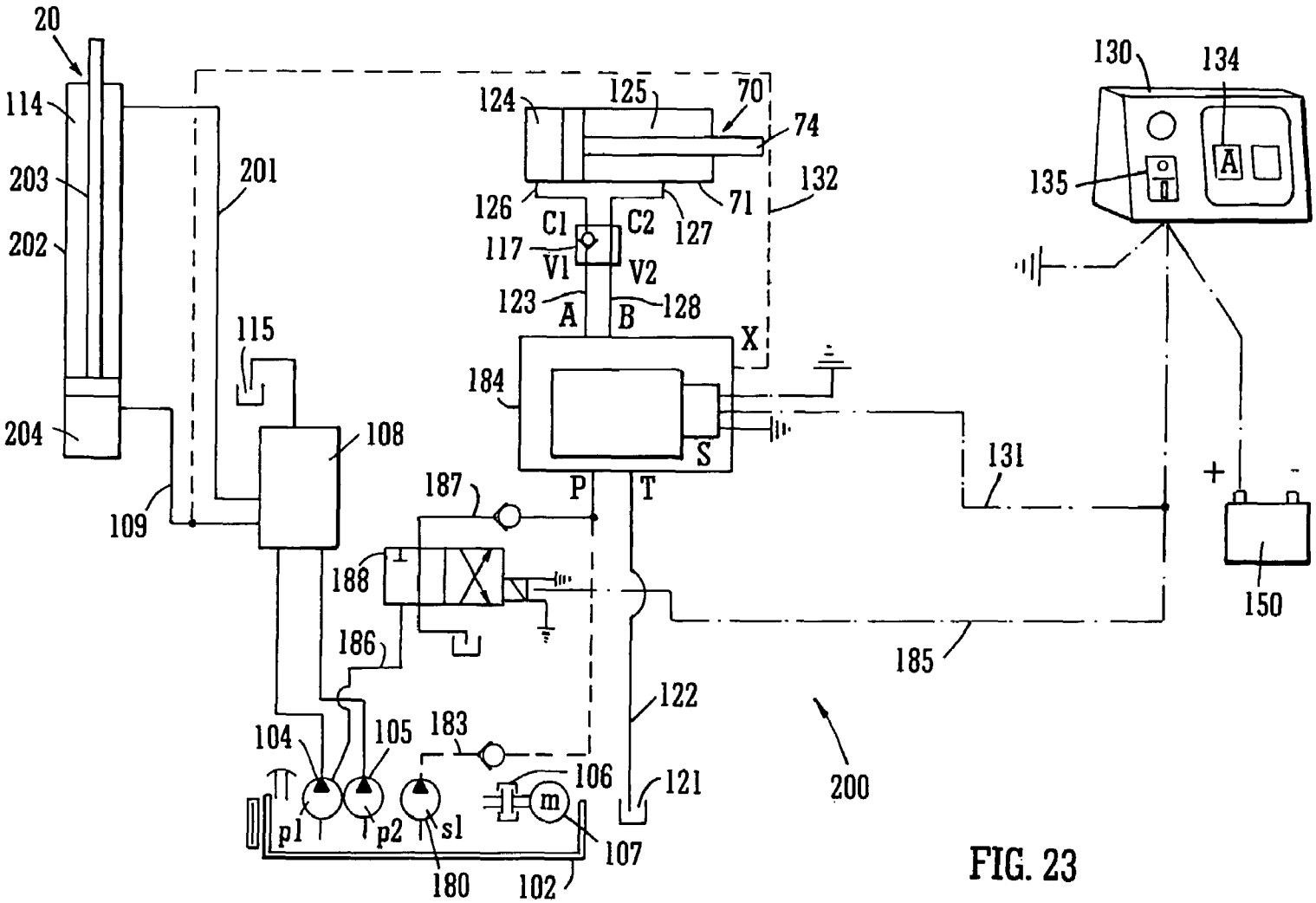
FIG. 23 is a diagrammatic representation showing hydraulic and electrical circuits forming part of a control system of a fourth embodiment of the control system of the present invention; the control system configured to select the engaged state of the engagement mechanism.
Figure 24:
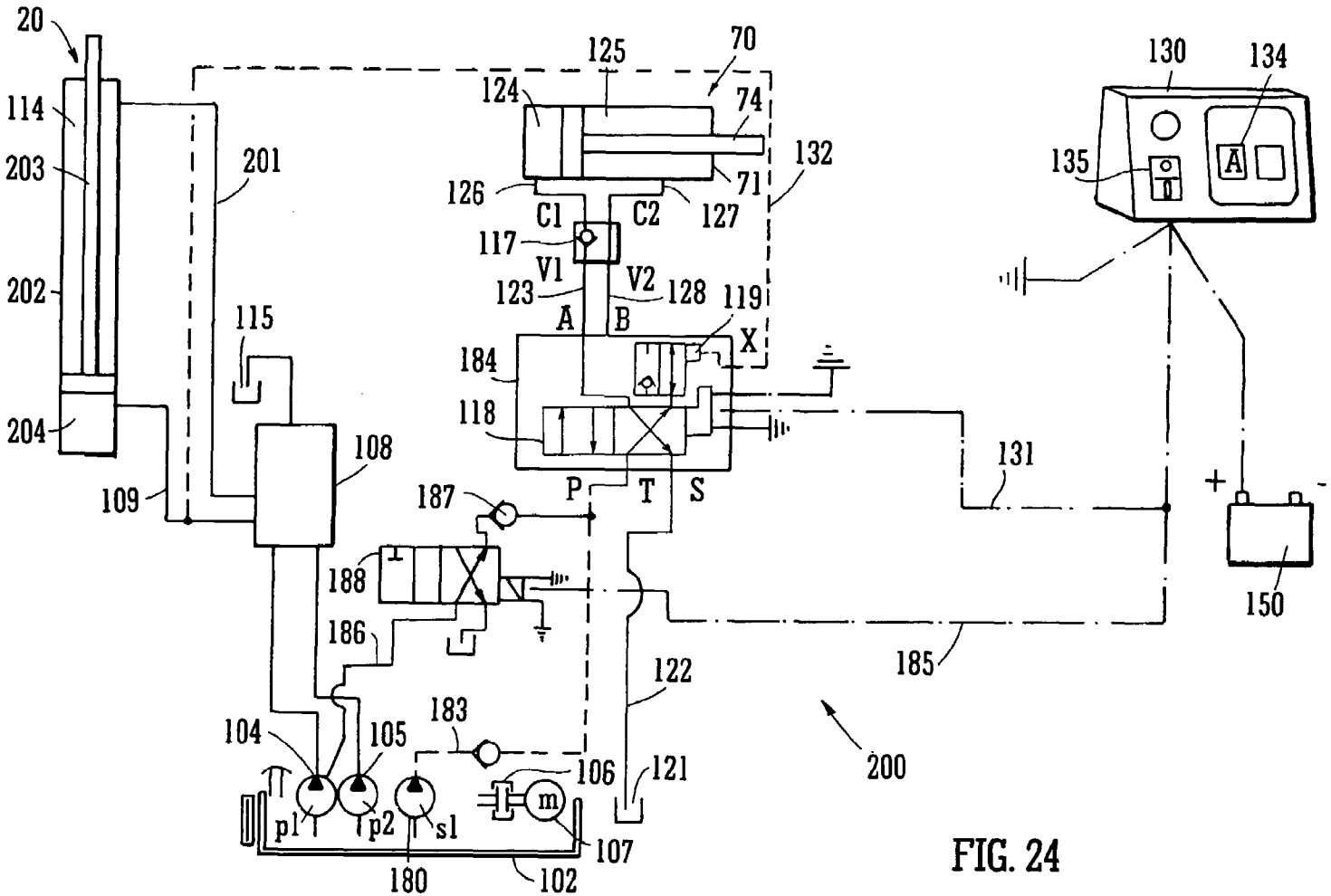
FIG. 24 is a diagrammatic representation showing hydraulic and electrical circuits forming part of a control system of a fourth embodiment of the control system of the present invention; the control system configured to select the disengaged state of the engagement mechanism.

FIGS. 23 and 24 shows a fourth embodiment of the control circuit of the current invention. FIG. 23 shows the circuit when the control system is set to outstroke the coupler 14 and FIG. 24 shows the circuit when the control system is set to instroke the coupler. This circuit operates in essentially the same manner as the circuits of FIGS. 17-22. However instead of one main pump (either pump 104 or pump 105) being used to both instroke and outstroke the coupler ram 70, the circuit of this embodiment is arranged to use one pump to instroke the ram and another pump to outstroke the ram. The circuit uses the servo pressure or low pressure pump 180 to outstroke the coupler ram 70 and the high pressure pump 104 to instroke the coupler ram 70. This circuit also uses an additional 4 port valve 188 to control the flow of oil through the system.

In the default (outstroked) position as shown in FIG. 23 the engagement member 58 is in the engaged state and the attachment is securely engaged with the coupler 14. In this position the servo pressure or servo pump 180 pumps oil from the main reservoir 102 through the hydraulic line 183 into the 5 port solenoid operated directional control logic valve 184. The oil then flows from the 5 port solenoid operated directional control logic valve 184, through to the pilot check valve 117 and into the bore area 124 of the coupler ram 70 via hydraulic lines 123 and 126, as in the previous embodiments. As the piston rod 74 is urged outwards with the increase in oil in the bore area 124, the oil in the annulus area 125 of the ram 70 is forced into the pilot operated check valve 117, from where it passes through the 5 port solenoid operated directional control logic valve 184, and into the reservoir 121 via the hydraulic line 122.

When the attachment is to be released from the coupler 14, the engagement member 58 is moved from the default engaged state to the disengaged state by action of the instroking of the coupler ram 70, as shown in FIG. 24. As in the previous embodiments, this requires the presence of two conditions. The first condition is the activation signal from the control console 130. This signal activates two electrical lines, the first line 185 acting so as to change the direction of flow through the 4 port valve 188, and the second line 131 acting so as change the direction of flow through the 4 port valve 118 located in the 5 port solenoid operated directional control logic valve 184, as in the previous embodiments. The second condition required is when the pressure signal in the line 132 is such that it activates the pressure valve 119 within the 5 port solenoid operated directional control logic valve 184. As in the previous embodiments, both of these activation signals must occur at the same time in order to successfully instroke the coupler ram 70.

Accordingly in the control circuit of the present embodiment, once the two conditions described above are satisfied, the pump 104 is enabled so as to pump oil to the hydraulic line 186. The oil then passes through the 4 port valve 188, and into the 4 port valve 118 located within the 5 port solenoid operated directional control logic valve 184 via the hydraulic line 187. The oil is then pumped through the pressure valve 119 also located in the 5 port solenoid operated directional control logic valve 184 to the pilot operated check valve 117 via the hydraulic line 128, and from there into the annulus area 125 of the coupler ram 70 via the hydraulic line 127. This increase in oil in the annulus area 125 causes the ram 70 to instroke, and forces the excess oil in the bore area 124 of the ram 70 to flow back through the system to the oil reservoir 121. As in the preferred embodiments, this instroking of the ram 70 moves the engagement member 58 so as to enable releasement of the attachment from the coupler 14.

Figure 25B:
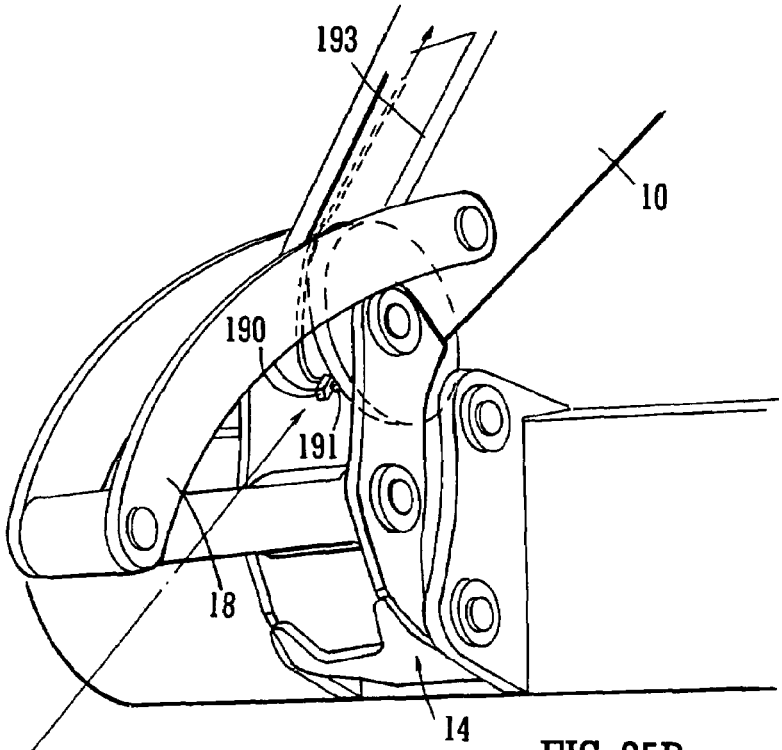
FIG. 25 shows an alternative arrangement for generating one of the activation signals of the control system of the present invention, the activation signal being generated from a proximity sensor.
Figure 25C:
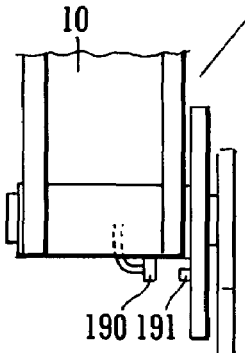
Figure 25A:
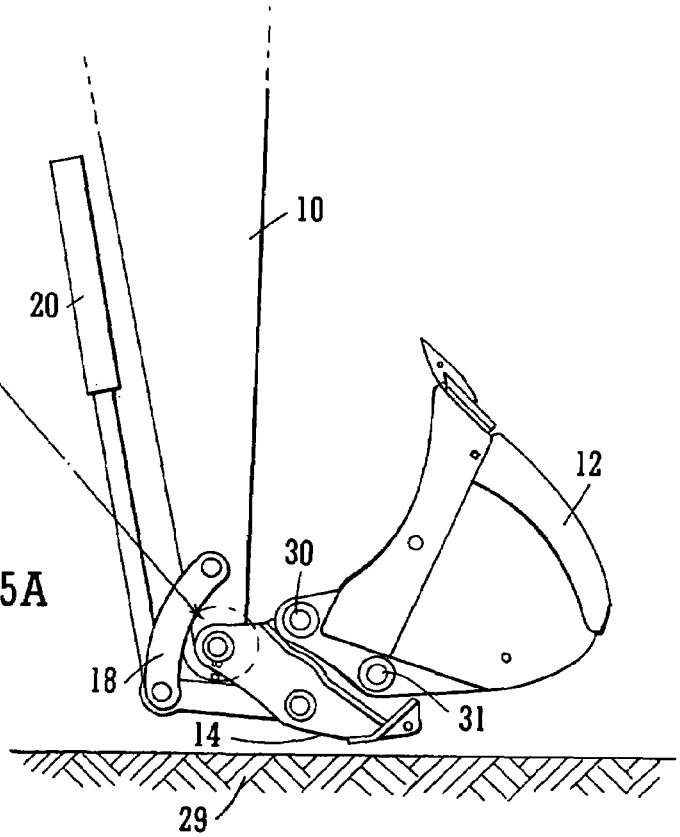

In an alternative embodiment of the control system of the present invention, the activation signal fulfilling one of the conditions which permit the opening of the valve 119 of the control system 200 (see for example FIG. 24) to enable the commencement of the instroking of the coupler ram 70 is generated from an electrical signal transmitted from a positional sensor which in the embodiment is a proximity sensor in the form of a reed switch 190. The positioning sensor is a two part sensor. FIGS. 25*a-c* shown such an arrangement. In the arrangement as shown in FIG. 25*a,* the reed switch 190 is fitted to the dipper arm 10, and a magnet 191 is fitted to the connecting linkage 18 attached to the dipper arm 10, so that the switch 190 and magnet 191 align with each other when the crowd ram 20 is fully outstroked. An electrical wire 193 is connected to the reed switch to enable the transmission of an actuation signal to the valve 119 located on the control circuit (not shown).

Such a proximity switch is designed to generate an electrical signal only when the switch 190 is in direct alignment with the magnet 191. As the switch 190 and magnet 191 are positioned so as to only align when the crowd ram 20 is fully outstroked, an electrical signal will only be transmitted to the valve 1 19 when the attachment 12 is in such a position where an actuation of the engagement mechanism of the coupler 14 to release the attachment from the coupler would not cause the attachment to fall from the coupler. FIG. 25*b* shows the position where release of the attachment from the coupler is permitted. FIG. 25*c* shows an exploded view of FIG. 25*b* where it can be seen that in this position the switch 190 is aligned with the magnet 191. In this position the switch 190 transmits an electrical signal through the electrical wire 193 fulfilling one condition to permit actuation of the engagement mechanism.

The invention is not limited to the embodiments hereinbefore described which may be varied in construction and detail.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

The words "comprises/comprising" and the words "having/including" when used herein with reference to the present invention are used to specify the presence of stated features, integers, steps or components but does not preclude the presence or addition of one or more other features, integers, steps, components or groups thereof.

The invention claimed is:

1. A control system for controlling the release of an accessory from a quick hitch coupler coupling the accessory to a hydraulically operable arm of a machine, the hydraulically operable arm being operable by a pressurized hydraulic system of the machine the coupler having:

a body member adapted for coupling to the arm;

an engagement mechanism, arranged on the body member, for releasably engaging the accessory, the engagement mechanism being actuatable to move the engagement mechanism between a first accessory engaged state in which the engagement mechanism engages the accessory securely for working of the accessory by the arm and a second accessory disengaged state in which the accessory is removable from the coupler;

wherein the control system incorporates a safety control for preventing actuation of the engagement mechanism from the accessory engaged state to the accessory disengaged state if the hydraulic pressure in at least one selected part of the hydraulic system operating to move the coupler relative to the arm does not exceed a threshold value.

2. The control system according to claim 1, wherein the machine has a hydraulic ram which moves the coupler relative to the arm, and the threshold value is measured from a hydraulic feed to that hydraulic ram.

3. The control system according to claim 2, wherein the hydraulic system has a hydraulic line connected between a control valve, and the hydraulic ram and the threshold value is measured at the hydraulic line.

4. The control system according to claim 2, wherein the hydraulic system has a valve controlling the hydraulic fluid flow to the ram, and the threshold value is measured at the valve.

5. The control system according to claim 2, wherein the hydraulic ram has an outstroke feed, and wherein the pressure in the outstroke feed is used by the control system to determine if the threshold value has been exceeded.

6. The control system according to claim 4, wherein valve is a servo valve which controls hydraulic fluid from a servo pump, and the pressure at the servo valve is used by the control system to determine if the threshold value has been exceeded.

7. The control system according to claim 1, wherein the control system is remotely operable.

8. The control system according to claim 1 wherein the engagement mechanism is driven by a hydraulically driven mechanism which is actuatable to move the engagement mechanism between the engaged and disengaged states.

9. The control system according to claim 8 wherein the hydraulically driven mechanism includes a high pressure pump and a servo pump, wherein either pump may be selected to move the engagement mechanism into a first accessory engaged state.

10. The control system according to claim 9 wherein the servo pump is used to move the engagement mechanism into a first accessory engaged state and the high pressure pump is used to move the engagement mechanism into an accessory disengaged state.

11. The control system according to claim 8 wherein the hydraulic mechanism opens at least one side of opposing grips which close to grip the accessory for working thereof on the arm, and which open to at least partially engage the accessory.

12. The control system according to claim 8 wherein the safety control prevents the flow of hydraulic fluid to the hydraulic mechanism of the engagement mechanism whenever the relative positions of the arm and the accessory are at a non-desirable disengaged state.

13. The control system according to claim 1 further comprising a pressure sensor for communication with a hydraulic line of a machine to which the control system is fitted; the pressure sensor for controlling the actuation of the engagement mechanism from the accessory engaged state to the accessory disengaged state if the accessory is not in one or more predetermined positions relative to the arm.

14. The control system according to claim 13 wherein the pressure sensor is a pressure sensitive valve in communication with a hydraulic feed line of the hydraulic mechanism.

15. The control system according to claim 13 wherein the pressure sensor activates when a control pressure is reached within the hydraulic line.

16. The control system according to claim 13 wherein the pressure sensor activates when a control pressure is reached at the servo port of the control valve of the machine.

17. The control system according to claim 1 further comprising a proximity sensor in communication with the control system; the proximity sensor for controlling the actuation of the engagement mechanism from the accessory engaged state to the accessory disengaged state if the accessory is not in one or more predetermined positions relative to the arm.

18. The control system according to claim 17 where the proximity sensor provides an electrical signal to enable actuation of the engagement mechanism from the accessory engaged state to the accessory disengaged state when the accessory is in one or more predetermined positions relative to the arm.

19. The control system according to claim 1 further comprising one or more other controls for preventing inadvertent actuation of the engagement mechanism from the accessory engaged state to the accessory disengaged state.

20. The control system according to claim 19 wherein the engagement mechanism can only be actuated to move to the disengaged state if two or more conditions are fulfilled simultaneously.

21. An excavator machine having a control system of claim 1 fitted thereto.

22. An excavator machine having the control system according to claim 19, the quick hitch coupler further comprising a body member adapted for coupling to the dipper arm, a fixed engaging means mounted on the body member for engaging a first one of a pair of coupling pins mounted on the accessory, a moveable engaging means mounted on the body member for engaging a second one of the pair of coupling pins of the accessory, the moveable engaging means being moveable between an engaged state with the moveable engaging means engaging the second coupling pin while the fixed engaging means engages the first coupling pin for coupling the accessory to the coupler, and a disengaged state for disengaging the second coupling pin, a latch co-operable with the fixed engaging means for retaining the first coupling pin of the accessory engaged in the fixed engaging means the latch being alternately operable in a latched state co-operating with the fixed engaging means for retaining the first coupling pin in the fixed engaging means, and an unlatched state for releasing the first coupling pin from the fixed engaging means, an urging means for urging the latch into the latched state, and a drive means acting between the moveable engaging means and the latch for urging the moveable engaging means between the engaged state and the disengaged state, and for urging the latch from the latched state to the unlatched state against the urging action of the urging means when the moveable engaging means is in the disengaged state.

23. The control system according to claim 1, quick hitch coupler for coupling an accessory to a clipper arm of a back actor, the quick hitch coupler further comprising a body member adapted for coupling to the dipper arm, a fixed engaging means mounted on the body member for engaging a first one of a pair of coupling pins mounted on the accessory, a moveable engaging means mounted on the body member for engaging a second one of the pair of coupling pins of the accessory, the moveable engaging means being moveable between an engaged state with the moveable engaging means engaging the second coupling pin while the fixed engaging means engages the first coupling pin for coupling the accessory to the coupler, and a disengaged state for disengaging the second coupling pin, a latch co-operable with the fixed engaging means for retaining the first coupling pin of the accessory engaged in the fixed engaging means the latch being alternately operable in a latched state co-operating with the fixed engaging means for retaining the first coupling pin in the fixed engaging means, and an unlatched state for releasing the first coupling pin from the fixed engaging means, an urging means for urging the latch into the latched state, and a drive means acting between the moveable engaging means and the latch for urging the moveable engaging means between the engaged state and the disengaged state, and for urging the latch from the latched state to the unlatched state against the urging action of the urging means when the moveable engaging means is in the disengaged state being controlled by the control system.

24. The control system according to claim 1, Wherein a kit comprising the quick hitch coupler for coupling an accessory to a dipper arm of a back actor, the quick hitch coupler comprising a body member adapted for coupling to the dipper arm, a fixed engaging means mounted on the body member for engaging a first one of a pair of coupling pins mounted on the accessory, a moveable engaging means mounted on the body member for engaging a second one of the pair of coupling pins of the accessory, the moveable engaging means being moveable between an engaged state with the moveable engaging means engaging the second coupling pin while the fixed engaging means engages the first coupling pin for coupling the accessory to the coupler, and a disengaged state for disengaging the second coupling pin, a latch co-operable with the fixed engaging means for retaining the first coupling pin of the accessory engaged in the fixed engaging means the latch being alternately operable in a latched state co-operating with the fixed engaging means for retaining the first coupling pin in the fixed engaging means, and an unlatched state for releasing the first coupling pin from the fixed engaging means, an urging means for urging the latch into the latched state, and a drive means acting between the moveable engaging means and the latch for urging the moveable engaging means between the engaged state and the disengaged state, and for urging the latch from the latched state to the unlatched state against the urging action of the urging means when the moveable engaging means is in the disengaged state and the control system.

25. The control system according to claim 1, combined control and coupler system having the quick hitch coupler couples an accessory to a dipper arm of a back actor, the quick hitch coupler further comprising a body member adapted for coupling to the dipper arm, a fixed engaging means mounted on the body member for engaging a first one of a pair of coupling pins mounted on the accessory, a moveable engaging means mounted on the body member for engaging a second one of the pair of coupling pins of the accessory, the moveable engaging means being moveable between an engaged state with the moveable engaging means engaging the second coupling pin while the fixed engaging means engages the first coupling pin for coupling the accessory to the coupler, and a disengaged state for disengaging the second coupling pin, a latch co-operable with the fixed engaging means for retaining the first coupling pin of the accessory engaged in the fixed engaging means the latch being alternately operable in a latched state co-operating with the fixed engaging means for retaining the first coupling pin in the fixed engaging means, and an unlatched state for releasing the first coupling pin from the fixed engaging means, an urging means for urging the latch into the latched state, and a drive means acting between the moveable engaging means and the latch for urging the moveable engaging means between the engaged state and the disengaged state, and for urging the latch from the latched state to the unlatched state against the urging action of the urging means when the moveable engaging means is in the disengaged state and the control system.

26. The control system for controlling the release of an accessory from a coupler coupling the accessory to a hydraulically operable arm of a machine, the coupler having:

a body member adapted for coupling to the arm;

an engagement mechanism, arranged on the body member, for releasably engaging the accessory, the engaging means being actuatable to move an engagement mechanism between a first accessory engaged state in which the engagement mechanism engages the accessory securely for working of the accessory by the arm and a second accessory disengaged state in which the accessory is removable from the coupler;

wherein the control system incorporates a safety control for preventing actuation of the engagement mechanism from the accessory engaged state to the accessory disengaged state if the coupler is not in one or more predetermined positions relative to the arm.

27. The control system according to claim 26 wherein said one or more predetermined positions relative to the arm in which the safety control does not prevent actuation of the engagement mechanism to the disengaged state is a position in which an accessory is removable from the coupler but in which the accessory is not completely disengaged from the coupler.

28. The control system according to claim 26 wherein said one or more predetermined positions relative to the arm in which the safety control does prevent actuation of the engagement mechanism to the disengaged state is a position in which an accessory is automatically completely disengageable from the coupler.

29. The control system according to claim 27 wherein said one or more predetermined positions at which the release of the accessory is allowed by the safety control are those in which the position to which the accessory is releasable is a partially disengaged position.

30. The control system according to claim 27 wherein said partially released position is one which holds an accessory from falling from the coupler under gravity.

* * * * *